US012312800B2

(12) United States Patent
Rubler

(10) Patent No.: US 12,312,800 B2
(45) Date of Patent: May 27, 2025

(54) MODULAR HOUSING SYSTEM AND METHODS FOR USING THE SAME

(71) Applicant: Vessel Technologies, Inc., New York, NY (US)

(72) Inventor: Neil Rubler, New York, NY (US)

(73) Assignee: Vessel Technologies, Inc., New York, NY (US)

( * ) Notice: Subject to any disclaimer, the term of this patent is extended or adjusted under 35 U.S.C. 154(b) by 0 days.

(21) Appl. No.: 16/921,612

(22) Filed: Jul. 6, 2020

(65) Prior Publication Data

US 2020/0332513 A1 Oct. 22, 2020

Related U.S. Application Data

(63) Continuation of application No. 16/043,671, filed on Jul. 24, 2018, now Pat. No. 10,704,251.

(Continued)

(51) Int. Cl.

| | |
|---|---|
| ***E04B 1/348*** | (2006.01) |
| ***E04B 1/343*** | (2006.01) |
| *E04H 1/00* | (2006.01) |

(52) U.S. Cl.

CPC ..... *E04B 1/34861* (2013.01); *E04B 1/34331* (2013.01); *E04B 1/34869* (2013.01); *E04B 2001/34892* (2013.01); *E04H 1/005* (2013.01)

(58) Field of Classification Search

CPC .. E04B 1/348; E04B 1/34861; E04B 1/34331; E04B 1/34869; E04B 1/3483;

(Continued)

(56) References Cited

U.S. PATENT DOCUMENTS

| | | | |
|---|---|---|---|
| D103,948 | S | 4/1937 | Mccornack |
| D136,671 | S | 11/1943 | Le |

(Continued)

FOREIGN PATENT DOCUMENTS

| | | |
|---|---|---|
| CN | 308205653 | 5/2023 |
| JP | D1743177 | 5/2023 |

OTHER PUBLICATIONS

Notice of Allowance dated Apr. 24, 2020 in U.S. Appl. No. 16/043,671, pp. 1-32.

(Continued)

*Primary Examiner* — Kyle J. Walraed-Sullivan
(74) *Attorney, Agent, or Firm* — Byrne Poh LLP

(57) ABSTRACT

A modular housing system and methods for using the same are provided. In accordance with some embodiments of the disclosed subject matter, the modular housing system comprises: a plurality of prefabricated system modules that are vertically aligned with each other and joined with a first fastener assembly to form a central system module having a front perimeter portion and a rear perimeter portion; a mechanical, electrical, and plumbing (MEP) module that is connected to the rear perimeter portion of the central system module; an elevator module that is connected to the front perimeter portion of the central system module; and a plurality of prefabricated housing modules that are connected to the central system module, the MEP module, and the elevator module, wherein each of the plurality of prefabricated housing modules is vertically aligned with each other to form a stacked housing unit and joined to the central system module and the elevator module with a second fastener assembly.

20 Claims, 26 Drawing Sheets

Related U.S. Application Data

(60) Provisional application No. 62/536,825, filed on Jul. 25, 2017.

(58) Field of Classification Search
CPC ..... E04B 1/34336; E04B 2001/34892; E04B 2001/34389; E04H 2001/1283; E04H 1/005; E04H 1/04; E04H 1/1205; B65D 88/022; B65D 88/121
USPC ..... 52/79.9, 79.2, 79.1, 79.5
See application file for complete search history.

(56) References Cited

U.S. PATENT DOCUMENTS 2,621,765 A 12/1952 Wood
D191,301 S 9/1961 Groseclose et al.
3,229,431 A * 1/1966 Paul ..... E04B 1/3483 52/79.13
3,503,170 A ‡ 3/1970 Shelley ..... E04B 1/34823 52/79.2
3,527,002 A 9/1970 Wood
3,541,744 A * 11/1970 Maxwell ..... E04B 1/34807 52/73
3,613,321 A ‡ 10/1971 Rohrer ..... E04B 1/34 52/73
3,623,296 A * 11/1971 Santoro ..... E04B 1/34807 52/79.12
3,643,390 A * 2/1972 Shelley ..... E04B 1/34823 52/79.2
3,656,266 A * 4/1972 Tylius ..... E04B 1/04 52/30
3,694,977 A * 10/1972 Verman ..... E04B 1/34823 52/79.7
3,703,058 A * 11/1972 Klett ..... E04B 1/34823 52/79.13
3,716,954 A ‡ 2/1973 Kelbish ..... E04B 1/34815 52/79.2
3,726,053 A * 4/1973 Filipek ..... E04G 21/161 52/123.1
3,742,666 A * 7/1973 Antoniou ..... E04F 17/08 52/309.7
3,751,864 A * 8/1973 Berger ..... E04B 1/348 52/79.11
3,755,974 A * 9/1973 Berman ..... E04B 1/34869 52/73
3,800,493 A * 4/1974 Livingston ..... E04B 1/34869 52/745.03
3,805,461 A * 4/1974 Jagoda ..... E04B 1/34823 52/79.11
3,818,654 A * 6/1974 Schramm ..... E04B 1/3483 52/79.7
3,835,601 A * 9/1974 Kelbish ..... E04B 1/34823 52/79.2
3,866,672 A * 2/1975 Rich, Jr. ..... F24F 3/044 165/50
3,894,373 A * 7/1975 Willingham ..... E04B 1/34823 52/236.3
3,897,662 A * 8/1975 Fencl ..... E04C 2/521 52/79.2
3,923,096 A * 12/1975 van der Lely ..... F24F 3/044 165/48.1
3,990,193 A * 11/1976 Ray ..... E04B 1/162 52/79.11
4,050,215 A * 9/1977 Fisher ..... E04B 1/34815 52/79.3
4,059,931 A * 11/1977 Mongan ..... E04B 1/22 52/79.12
4,073,102 A * 2/1978 Fisher ..... E04B 1/34823 52/223.4
4,078,345 A * 3/1978 Piazzalunga ..... E04B 1/04 52/236.9
4,107,886 A * 8/1978 Ray ..... E04B 1/162 52/431
4,118,905 A * 10/1978 Shelley ..... E04B 1/34823 52/236.4
D265,424 S 7/1982 Kennedy et al.
4,525,975 A * 7/1985 McWethy ..... E04B 1/34823 52/234
4,592,175 A * 6/1986 Werner ..... E04H 1/04 52/79.9
4,794,747 A * 1/1989 Yendo ..... E04H 1/04 52/236.3
4,930,273 A * 6/1990 Papesch ..... E04B 1/34861 52/185
5,076,310 A * 12/1991 Barenburg ..... E04B 2/82 137/15.08
5,402,608 A * 4/1995 Chu ..... E04B 1/3483 52/745.2
5,528,866 A * 6/1996 Yulkowski ..... E04H 1/04 52/79.12
6,393,774 B1 * 5/2002 Fisher ..... E04B 1/34823 52/236.3
6,712,414 B2 * 3/2004 Morrow ..... B60P 3/34 296/165
6,826,879 B1 * 12/2004 Allen ..... E04B 1/34815 52/143
8,186,109 B2 * 5/2012 Warminsky ..... E04H 9/10 52/79.1
8,484,929 B1 * 7/2013 Begdouri ..... E02D 29/045 52/745.03
9,441,357 B1 * 9/2016 Vafaee ..... E04B 1/34869
D886,323 S 6/2020 Yusupov
10,704,251 B1 7/2020 Rubler
2004/0040223 A1 * 3/2004 De La Marche ... E04B 1/34846 52/79.9
2005/0241242 A1 * 11/2005 De La Marche ... E04B 1/34815 52/79.1
2005/0262778 A1 * 12/2005 Allen ..... E04H 1/04 52/79.1
2006/0185262 A1 * 8/2006 Abler ..... E04B 1/3442 52/64
2007/0084135 A1 * 4/2007 Ritter ..... E04B 1/3444 52/79.1
2007/0107321 A1 * 5/2007 Sarine ..... E04B 1/34305 52/71
2007/0271857 A1 * 11/2007 Heather ..... B65D 90/006 52/79.9
2008/0134589 A1 * 6/2008 Abrams ..... E04B 1/34384 52/79.1
2008/0276553 A1 * 11/2008 Ingjaldsdottir ..... E04F 11/025 52/184
2009/0113821 A1 5/2009 Guo
2009/0151280 A1 * 6/2009 Jones ..... E04H 1/04 52/236.3
2009/0229194 A1 * 9/2009 Armillas ..... H05K 7/1497 52/79.1
2009/0307994 A1 * 12/2009 Cathcart ..... E04C 2/246 52/79.9
2010/0011676 A1 * 1/2010 Barry ..... E04B 1/3444 52/79.5
2010/0018131 A1 * 1/2010 Green ..... E04B 1/34807 52/79.5
2010/0043324 A1 * 2/2010 Lim ..... E04H 1/04 52/236.3
2011/0016801 A1 * 1/2011 Ziegelman ..... E04B 1/3483 52/79.9
2011/0041415 A1 * 2/2011 Esposito ..... E04B 1/34869 52/12
2011/0056147 A1 * 3/2011 Beaudet ..... E04B 1/34869 52/79.9
2011/0173907 A1 * 7/2011 Katsalidis ..... E04B 1/34869 52/236.3
2011/0179732 A1 7/2011 Erner et al.
2011/0265396 A1 * 11/2011 Heather ..... B65D 90/0026 52/79.9
2011/0296769 A1 * 12/2011 Collins ..... E04B 1/945 52/79.1
2011/0296789 A1 12/2011 Collins et al.
2011/0308175 A1 12/2011 Wu

(56) References Cited

U.S. PATENT DOCUMENTS

2012/0031345 A1* 2/2012 Rosenstein ..... B63B 25/004 119/408
2012/0073214 A1* 3/2012 Sie ..... B66B 11/0005 52/79.1
2012/0151851 A1* 6/2012 Cantin ..... E04B 1/34336 52/79.5
2012/0266546 A1* 10/2012 Gyory ..... E04B 1/34384 52/126.1
2012/0311938 A1* 12/2012 Larson ..... E04H 1/02 52/79.1
2013/0067832 A1 3/2013 Collins et al.
2013/0152485 A1* 6/2013 Austin ..... E04B 1/165 52/79.8
2013/0263527 A1* 10/2013 Barrett ..... E04H 15/008 52/79.1
2013/0291449 A1* 11/2013 Strickland ..... E04H 1/1205 52/79.5
2013/0305629 A1* 11/2013 Stephenson ..... E04B 1/3483 52/79.9
2014/0115976 A1* 5/2014 Lippert ..... E04H 1/005 52/79.2
2014/0248833 A1* 9/2014 Royle ..... A62B 3/00 454/257
2014/0298734 A1* 10/2014 Rogers ..... H05K 7/1495 52/79.9
2014/0298745 A1* 10/2014 Rechenmacher ..... E04B 1/165 52/425
2014/0318036 A1* 10/2014 Eom ..... E02D 27/12 52/79.1
2014/0352232 A1* 12/2014 Malakauskas ..... E04H 1/005 52/79.9
2015/0135636 A1* 5/2015 Ayres ..... B07B 15/00 52/745.03
2015/0152634 A1* 6/2015 Unger ..... E04H 3/02 52/79.2
2015/0240475 A1* 8/2015 Malakauskas ..... E04B 1/34861 52/79.13
2015/0266616 A1* 9/2015 Barrable ..... B65D 90/0006 206/512
2016/0040443 A1* 2/2016 Stephenson ..... E04H 1/005 52/79.5
2016/0069062 A1* 3/2016 Dynon ..... E04B 1/34384 52/79.5
2016/0130795 A1* 5/2016 Downey ..... E04B 1/34823 52/79.1
2016/0145853 A1* 5/2016 Timur ..... G06Q 20/405 705/5
2016/0160515 A1* 6/2016 Wallance ..... E04B 1/3483 52/79.1
2016/0312485 A1* 10/2016 Wilson ..... E04B 2/721
2017/0002579 A1‡ 1/2017 French ..... E04H 1/04
2017/0321415 A1* 11/2017 Vafaee ..... E04B 1/5831
2018/0109163 A1* 4/2018 Paine ..... H02K 7/1815
2018/0194442 A1* 7/2018 Loudrup ..... E04B 1/7675
2018/0230691 A1* 8/2018 Tsai ..... E04B 1/3442
2018/0230692 A1* 8/2018 Thebaud ..... E04H 1/005
2018/0328019 A1* 11/2018 Collins ..... E04B 1/40
2019/0119903 A1* 4/2019 Rebeil ..... E04B 1/36
2019/0144081 A1* 5/2019 Llago Hermida ..... B63B 25/00 114/71
2019/0186122 A1* 6/2019 Patterson ..... E04B 1/34861
2019/0186163 A1* 6/2019 Li ..... E04H 1/12
2019/0217929 A1* 7/2019 Lefevre ..... E04B 1/34815
2019/0234063 A1* 8/2019 Garcia-Abril Ruiz .... E04B 5/40
2019/0249413 A1* 8/2019 Brotherton ..... E04B 1/34321
2019/0257073 A1* 8/2019 Ledoux ..... B65D 90/008
2019/0284795 A1* 9/2019 Vanaman ..... E04B 1/3483
2019/0376276 A1* 12/2019 Lucho Do Valle ... E04H 1/1205

OTHER PUBLICATIONS

Office Action dated Jan. 14, 2020 in U.S. Appl. No. 16/043,671, pp. 1-35.

Restriction Requirement dated Sep. 30, 2024 in U.S. Appl. No. 29/898,283, pp. 1-32.

Stacom, Don, "Developer: Four Story Modular Apartment Building Would Help Ease Simsburys Affordable Housing Shortage", In Hartford Courant, Aug. 2, 2023, pp. 1-3, available at:https://www.courant.com/2023/02/08/developer-four-story-modular-apartment-building-would-help-ease-simsburys-affordable-housing-shortage/.

Vessel Technologies, "Vessel", last accessed Dec. 30, 2024, pp. 1-9, available at: https://www.vesseltechnologies.com.

* cited by examiner
‡ imported from a related application

MODULAR HOUSING SYSTEM AND METHODS FOR USING THE SAME

CROSS-REFERENCE TO RELATED APPLICATIONS

This application is a continuation of U.S. patent application Ser. No. 16/043,671, filed Jul. 24, 2018, which claims the benefit of U.S. Provisional Patent Application No. 62/536,825, filed Jul. 25, 2017, each of which is hereby incorporated by reference herein in its entirety.

TECHNICAL FIELD

The disclosed subject matter relates to a modular housing system and methods for using the same.

BACKGROUND

While populations in urban areas are generally increasing, there is a continued lack of affordable, quality housing, such as multiple unit dwellings. This lack of affordable and quality housing occurred because of a number of reasons. For example, developable land for constructing such multiple unit dwellings is in decreasing supply and, in many instances, owners of such developable land tend to demand high prices for forgoing the future and often unforeseeable development potential. In another example, aside from the fact that approaches for constructing these multiple unit dwellings have generally not evolved, these multiple unit dwellings, which include a number of housing units, are expensive to construct. Moreover, constructing such housing while conforming to local building codes can cause significant delays, thereby further increasing the cost and complexity of a multiple unit housing project.

In continuing with this example, upon constructing such housing, these multiple unit buildings are far too permanent and are difficult to renovate and/or modify based on the current needs of those living in the multiple unit buildings.

Accordingly, it is desirable to provide new modular housing systems and methods for using the same.

SUMMARY

A modular housing system and methods for using the same are provided.

In accordance with some embodiments of the disclosed subject matter, a modular housing system is provided, the modular housing system comprising: a plurality of prefabricated system modules that are vertically aligned with each other and joined with a first fastener assembly to form a central system module having a front perimeter portion and a rear perimeter portion; a mechanical, electrical, and plumbing (MEP) module that is connected to the rear perimeter portion of the central system module; an elevator module that is connected to the front perimeter portion of the central system module; and a plurality of prefabricated housing modules that are connected to the central system module, the MEP module, and the elevator module, wherein each of the plurality of prefabricated housing modules is vertically aligned with each other to form a stacked housing unit and joined to the central system module and the elevator module with a second fastener assembly.

In some embodiments, at least one of the MEP module and the elevator module is incorporated into the central system module.

In some embodiments, the MEP module includes an inner perimeter surface and an outer perimeter surface, where the inner perimeter surface of the MEP module is connected to the rear perimeter portion of the central system module and wherein the outer perimeter surface of the MEP module is connected to an egress stair module.

In some embodiments, the MEP module includes a plurality of utilities connectors that are configured to connect one of a plurality of utilities between a utilities source and at least one of the plurality of prefabricated housing modules, the plurality of prefabricated system modules, and the elevator module.

In some embodiments, the central system module has a left perimeter portion and a right perimeter portion, where a first plurality of prefabricated housing modules are connected at the left perimeter portion of the central system module and wherein a second plurality of prefabricated housing modules are connected at the right perimeter portion of the central system module.

In some embodiments, a number of housing modules in the plurality of prefabricated housing modules is the same as a number of prefabricated system modules in the plurality of prefabricated system modules.

In some embodiments, a number of housing modules in the plurality of prefabricated housing modules is different than a number of prefabricated system modules in the plurality of prefabricated system modules.

In some embodiments, each of the plurality of prefabricated housing modules is configured to be removed from the modular housing system and replaced with a replacement prefabricated housing portion.

In some embodiments, each of the plurality of prefabricated system modules is configured to be removed from the modular housing system and replaced with a replacement prefabricated housing module.

In some embodiments, the central system module is configured to be removed from the modular housing system and replaced with a replacement central system module.

In some embodiments, the MEP module is configured to be disconnected from the rear perimeter portion of the central system module and replaced with a replacement MEP module.

In some embodiments, the elevator module is configured to be disconnected from the front perimeter portion of the central system module and replaced with a replacement elevator module.

In some embodiments, an additional prefabricated system module is connected to a top perimeter surface of the central system module and an additional prefabricated housing module is connected to a top perimeter surface of an uppermost prefabricated housing module in the plurality of prefabricated system modules and wherein the additional prefabricated system module is connected to the additional prefabricated housing module.

In some embodiments, an additional MEP module is connected to the MEP module that is connected to the rear perimeter portion of the central system module, and wherein the additional MEP module is also connected to an additional prefabricated system module.

In some embodiments, a first prefabricated system module of the plurality of prefabricated system modules aligns and connects with a second prefabricated system module of the plurality of prefabricated system modules using twistlocks that interlock a receiving portion on the first prefabricated system module with an engagement portion of the second prefabricated system module.

In some embodiments, a first prefabricated housing module of the plurality of prefabricated housing modules aligns and connects with a second prefabricated housing module of the plurality of prefabricated housing modules using twistlocks that interlock a receiving portion on the first prefabricated housing module with an engagement portion of the second prefabricated housing module.

In some embodiments, one of the plurality of prefabricated system modules includes a first hollow structural section, one of the plurality of prefabricated housing modules includes a second hollow structural section, and the elevator module includes a third hollow structural section, where the first hollow structural section is joined to the second hollow structural section and where the second hollow structural section is joined to the third hollow structural section.

In some embodiments, each of the prefabricated housing modules comprises a shell portion, where each of the prefabricated housing modules comprises a plurality of cassettes that are each installed within a prefabricated housing module along the shell portion of the prefabricated housing module.

In some embodiments, each of the plurality of cassettes corresponds with an area within the prefabricated housing module, wherein the area is one of: a bedroom area, a bathroom, a kitchen area, a living room area, and a dining area.

BRIEF DESCRIPTION OF THE DRAWINGS

Various objects, features, and advantages of the disclosed subject matter can be more fully appreciated with reference to the following detailed description of the disclosed subject matter when considered in connection with the following drawings, in which like reference numerals identify like elements.

DETAILED DESCRIPTION

In accordance with various embodiments of the disclosed subject matter, a modular housing system and methods for using the same are provided.

Generally speaking, the modular housing system can include multiple prefabricated housing modules that are connected to a central system module, which can be formed from multiple prefabricated system modules that are connected together. For example, multiple prefabricated housing modules that each have the same or similar dimensions can be vertically aligned and connected to form a stacked housing module, where the multiple prefabricated housing modules in the stacked housing module can be connected to the central system module (which may include a mechanical, electrical, and plumbing (MEP) connection module, an elevator module, an egress stair module, etc.). The central system module is sometimes referred to herein as the "STEM" module.

In some embodiments, the modular housing system can include multiple prefabricated system modules that are vertically aligned with each other and joined with fasteners to form a central system module. For example, as shown in FIGS. 1A-1F, the central system module can include five prefabricated system modules in which an upper perimeter portion of a lower prefabricated system module is connected with a lower perimeter portion of an adjacent prefabricated system module using a fastener or any other suitable joining mechanism. It should be noted that any suitable number of prefabricated system modules can be connected to form the central system module. It should also be noted that, although the prefabricated system modules shown in FIGS. 1A-1F are substantially similar in dimension, this is merely illustrative and each of the prefabricated system modules that are connected in a stacked housing unit can have varying dimensions.

Figure 1A:
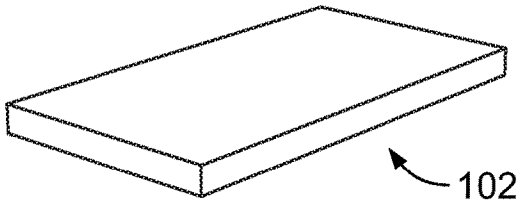
FIGS. 1A-1F show illustrative examples of a process for constructing a modular housing arrangement that includes a central system module that includes one or more prefabricated system modules in accordance with some embodiments of the disclosed subject matter.
Figure 1B:
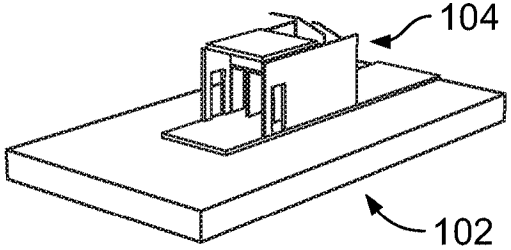
Figure 1C:
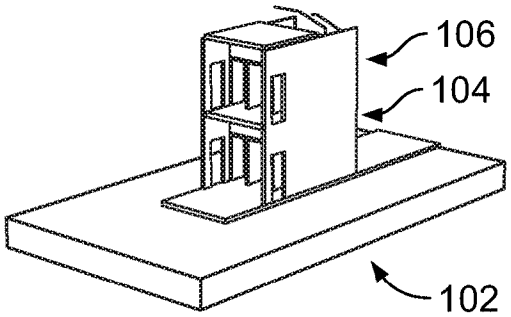

As shown in FIG. 1A, the modular housing system can begin with a foundation 102 or any suitable site for constructing the modular housing system (e.g., a pier foundation, a raft foundation, or any other suitable type of foundation). As shown in FIG. 1B, a first prefabricated system module 104 can be positioned on foundation 102. For example, first prefabricated system module 104 can be secured to foundation 102. As shown in FIG. 1C, a second prefabricated system module 106 can be vertically aligned and positioned on first prefabricated system module 104. In a more particular example, an upper perimeter portion of first prefabricated system module 104 can be aligned and connected with a lower perimeter portion of second prefabricated system module 106. Illustrative examples of fasteners or connectors that connect at least two prefabricated system modules are further shown in FIGS. 10 and 11.

Figure 1D:
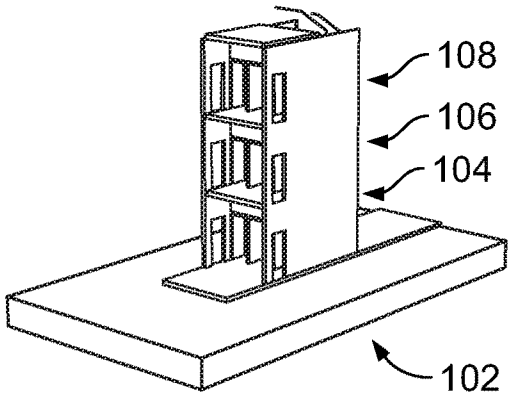

As shown in FIG. 1D, a third prefabricated system module 108 can be vertically aligned and positioned on second prefabricated system module 106. In a more particular example, an upper perimeter portion of second prefabricated system module 106 can be aligned and connected with a lower perimeter portion of third prefabricated system module 108.

It should be noted that, in some embodiments, second prefabricated system module 106 can be removed and/or replaced with another prefabricated system module. For example, second prefabricated system module 106 can be replaced with third prefabricated system module 108. In a more particular example, second prefabricated system module 106 can be disconnected from first prefabricated system module 104 and, using a crane, second prefabricated system module 106 can be removed and replaced with third prefabricated system module 108, which may include updated features for use with a prefabricated housing module that is connected to and horizontally adjacent to third prefabricated system module 108.

Figure 1E:
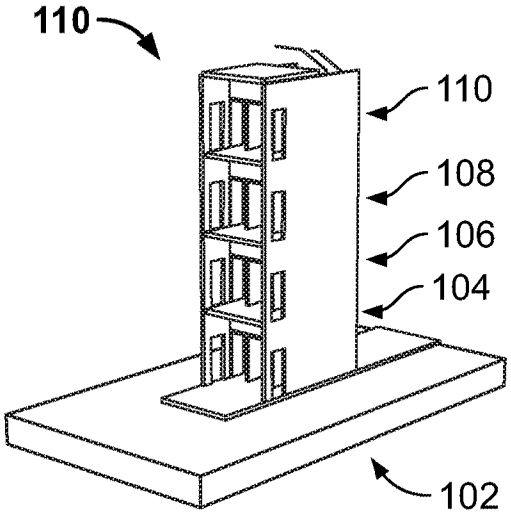

In continuing the above-mentioned example, as shown in FIG. 1E, a fourth prefabricated system module 110 can be vertically aligned and positioned on third prefabricated system module 108. In a more particular example, an upper perimeter portion of third prefabricated system module 108 can be aligned and connected with a lower perimeter portion of fourth prefabricated system module 110.

Figure 1F:
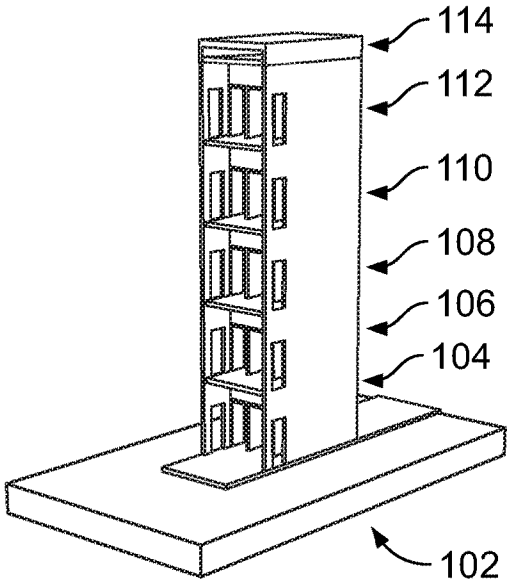

As shown in FIG. 1F, a fifth prefabricated system module 112 can be vertically aligned and positioned on fourth prefabricated system module 110. In a more particular example, an upper perimeter portion of fourth prefabricated system module 110 can be aligned and connected with a lower perimeter portion of fifth prefabricated system module 112.

In some embodiments, a roof portion 114 can be connected to an upper perimeter portion of the uppermost prefabricated system module. For example, as also shown in FIG. 1F, roof portion 114 is connected to the upper perimeter portion of fifth prefabricated system module 112. It should be noted that, in some embodiments, roof portion 114 can be disconnected from fifth prefabricated system module 112 to, for example, insert one or more additional prefabricated system modules or remove one or more currently installed system modules. It should be noted that, in some embodiments, roof portion 114 can be omitted from the central system module.

Figure 5:
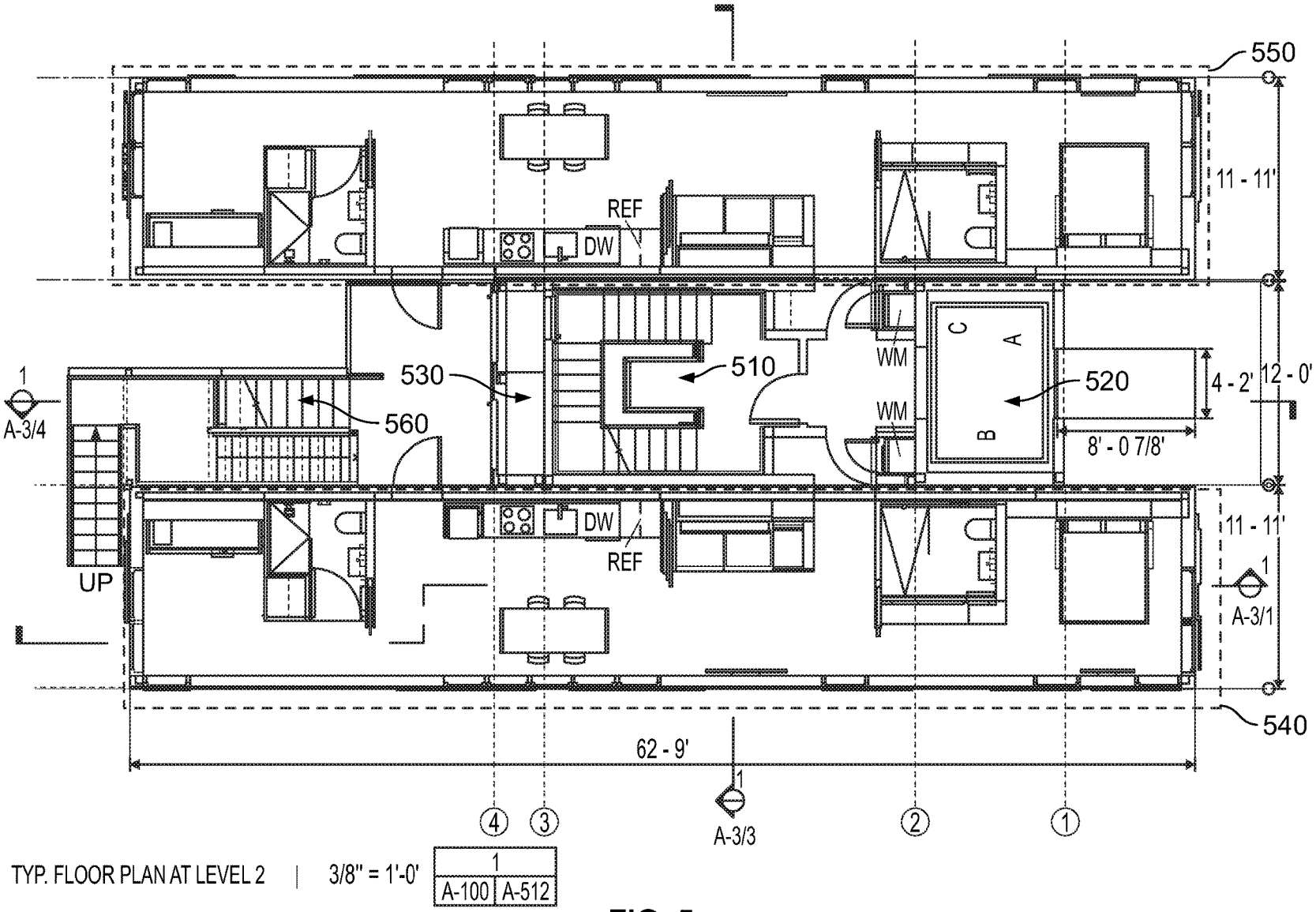
FIGS. 5 and 6 show illustrative top-down views of a level of the modular housing system in accordance with some embodiments of the disclosed subject matter.
Figure 6:
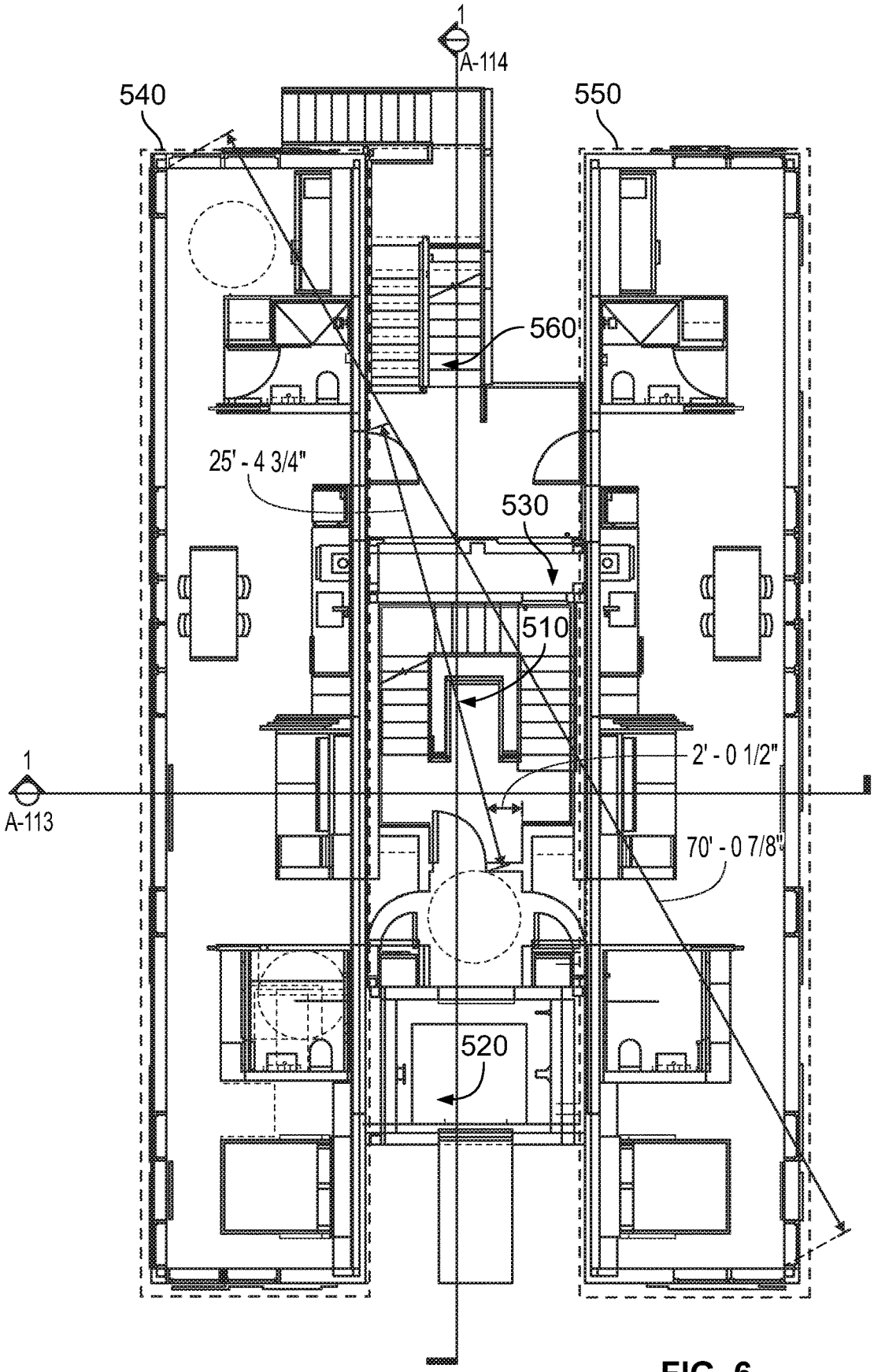

It should be noted that any suitable system support features can be included in each prefabricated system module. For example, as shown in FIGS. 5 and 6, a top-down view of one level of the modular housing system shows that central system module 510 can include a portion of egress stairs, a walkway, an entryway to an elevator module or another portion of the system module, etc. As also shown in FIGS. 5 and 6, portions of central system module 510, such as corner portions, can be connected to MEP module 520, elevator module 530, first housing module 540, and second housing module 550. These modules can be connected using the connection mechanisms shown in FIGS. 10 and 11.

Figure 7:
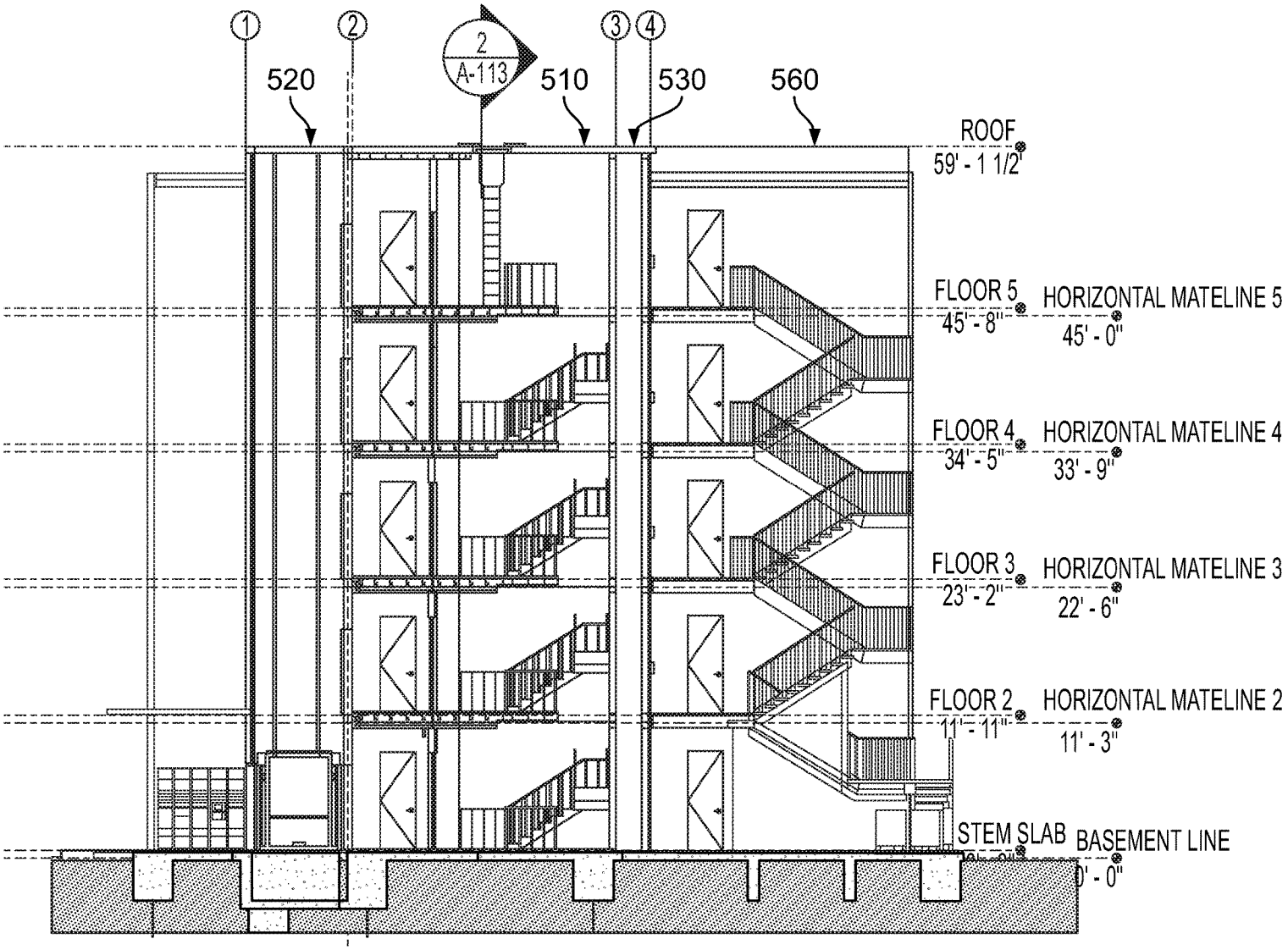
FIG. 7 shows an illustrative view showing the internal and external stairs of the central system module and the egress stair module in accordance with some embodiments of the disclosed subject matter.

Turning to FIG. 7, a side view of the modular housing system shows that multiple system modules (e.g., five prefabricated system modules) have been connected to form central system module 510. For example, when the system modules are connected in FIG. 7, central system module 510 can form an internal staircase that allows one to traverse different levels of the modular housing system, access different system modules, access different housing modules, access a portion of the MEP module 530, access a roof portion above the uppermost system module, and/or access an elevator module 520.

It should be noted that, although the embodiments described herein generally describe that the central system module is connected to additional system components, such as a MEP module, an elevator module, and an egress stairway module, this is merely illustrative and one or more of these additional system components can be incorporated into the central system module. For example, central system module or any one of the individual prefabricated system modules can include features, such as an elevator system, a dumbwaiter system for distributing packages, one or more connectors for providing water, hot water (e.g., plumbing risers), electricity (e.g., electrical conduits), sewage, and/or heat, ventilation, and air conditioning (HVAC) (e.g., HVAC ducts), etc. to the system portion and the housing portion connected to the system portion, garbage disposal, Internet connection, etc. In another other example, central system module or any one of the individual prefabricated system modules can include stairways, water heaters, air conditioners, fuel oil systems, water pumps, energy storage units, rain water collection systems, water purification systems, power inverters, solar panels, waste pumps, compost systems, fire protection systems, any other suitable features and/or systems, or any suitable combination thereof.

Figure 2C:
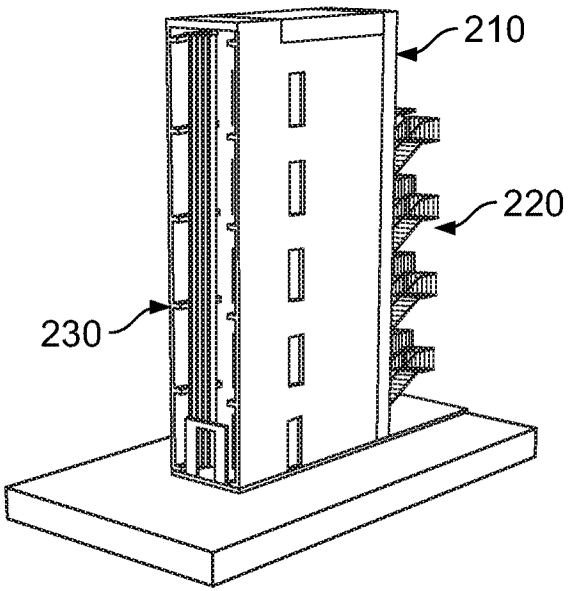
FIGS. 2A-2C show illustrative examples of a process for constructing a modular housing arrangement in which a mechanical, electrical, and plumbing (MEP) module, an egress stair module, and/or an elevator module are connected to the central system module in accordance with some embodiments of the disclosed subject matter.
Figure 2B:
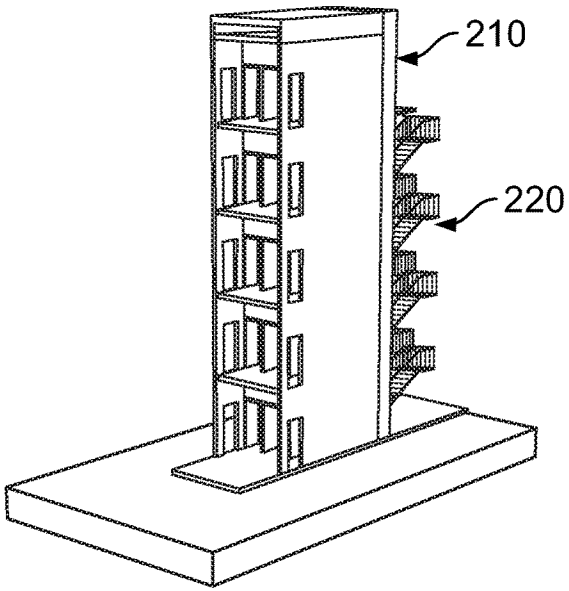
Figure 2A:
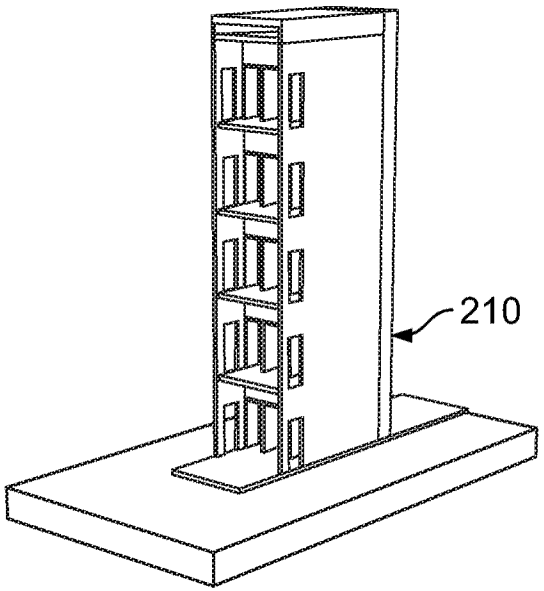

In some embodiments, the modular housing system can also include a mechanical, electrical, and plumbing (MEP) module. For example, as shown in FIG. 2A, a MEP module 210 (e.g., that spans the vertical length of the central system module) can include fittings that engage with corresponding fittings on a rear perimeter portion of the central system module. In a more particular example, MEP module 210 can include an inner perimeter surface and an outer perimeter surface, where the inner perimeter surface of MEP module 210 can include fittings that engage with corresponding fittings on a rear perimeter portion of the central system module. As shown in FIG. 2A, MEP module 210 can be positioned to extend between foundation 102 and roof portion 114.

As shown in FIGS. 5 and 6, a top-down view of one level of the modular housing system shows that MEP module 520 can include an inner region within a shaft for the placement and configuration of multiple mechanical, electrical, and plumbing connectors that can connect a prefabricated housing module to a corresponding source (e.g., a power source, a water source, etc.). As also shown in FIGS. 5 and 6, each corner portion of MEP module 520 can be connected to, for example, central system module 510, first housing module 540, second housing module 550, and/or egress stair module 560.

As shown in FIG. 7, a side view of the modular housing system shows that MEP module 530 can be connected to multiple system modules (e.g., five prefabricated system modules), which have been connected to form central system module 510. As also shown in FIG. 7, MEP module 530 can extend from the lowest system module to the highest system module.

In some embodiments, MEP module 210 can include any suitable mechanical support features, such as one or more HVAC ducts for a heating system and/or a cooling system. In some embodiments, MEP module 210 can include any suitable electrical support features, such as power supply and distribution components, information and telecommunications system components, control system components, security and access system components, detection and alarm system components, lighting system components, etc. In some embodiments, MEP module 210 can include any suitable plumbing support features, such as pipes, valves, risers, plumbing fixtures, tanks, etc. In a more particular example, plumbing support features can include potable water pipes, non-potable water pipes, cold water pipes, hot water pipes, fire protection pipes, rain water collection pipes, refrigeration piping, waste piping, drainage piping, and/or any other suitable type of piping.

It should be noted that MEP module 210 can leave minimal peripheral connections, thereby allowing one configuring the modular housing system to connect the plumbing lines, electrical wires, and ducts of MEP module 210 to the corresponding sources and to a prefabricating housing module (e.g., providing electricity, plumbing, HVAC, data, and/or control systems to the housing module).

It should also be noted that, in some embodiments, additional MEP modules can be connected to the initial MEP module. For example, upon adding additional prefabricated system modules and/or additional prefabricated housing modules, additional MEP modules can be vertically aligned and connected to the initial MEP module. In a more particular example, HVAC ducts, water risers, and conduit risers in an MEP module can be configured to facilitate future connection with HVAC ducts, water risers, and conduit risers of a systems module or additional MEP module to be connected when needed. For example, HVAC ducts, water risers, and conduit risers can span the vertical length (e.g., from floor to ceiling) of a prefabricated systems module. As another example, HVAC ducts, water risers, and conduit risers can be positioned within a prefabricated systems module with enough clearance to allow for larger HVAC ducts, water risers, and conduit risers of an updated systems module, positioned beneath a prefabricated systems module to be connected vertically (e.g., connected without requiring horizontal ductwork or piping). In some embodiments, conduits can include electrical wiring fitted with male and/or female plugs to facilitate attachment and/or detachment with electrical wiring of an attached prefabricated systems module.

It should also be noted that additional MEP modules can be connected to the initial MEP module in any suitable manner. For example, in some embodiments, an additional MEP module can be connected to the rear perimeter surface of MEP module 210. The additional MEP module can, for example, include additional HVAC ducts, water risers, and conduit risers needed to support the addition of prefabricated housing modules. In another example, the additional MEP module can, for example, include security and access system components that were not previously included in MEP module 210 and/or upgrade security and access system components that are included in MEP module 210.

It should further be noted that, as mentioned above, MEP module 210 can be incorporated as a part of the central system module. For example, alternatively to connecting MEP module 210 to a rear surface of the central system module as shown in FIG. 2B, a first MEP module in first prefabricated system module 104 can include mechanical, electrical, and plumbing connectors and a second MEP module in second prefabricated system module 106 can include mechanical, electrical, and plumbing connectors, where, upon connecting first prefabricated system module 104 to second prefabricated system module 106 using one or more fasteners, the corresponding mechanical, electrical, and plumbing connectors can be connected.

In some embodiments, the modular housing system can also include an egress stair module. For example, as shown in FIG. 2A, an egress stair module 220 can be connected to a rear perimeter portion of MEP module 210. In a more particular example, egress stair module 220 can include exterior exit stairways, ramps, and/or platforms that are bolted to the rear perimeter portion of MEP module 210 to provide a means of egress from one or more prefabricated housing modules. It should be noted that, in some embodiments, additional portions of egress stair module 220 can be added in response to connecting additional prefabricated housing modules.

As shown in FIGS. 5 and 6, a top-down view of one level of the modular housing system shows that egress stair module 560 can include a platform between entries into first housing module 540 and adjacent second housing module 550 that is connected to stairs to other levels of the modular housing system. As also shown in FIGS. 5 and 6, portions of egress stair module 560 can be connected (e.g., using bolts) to, for example, portions of MEP module 530, portions of first housing module 540, and portions of second housing module 550.

FIG. 7 also shows that portions of egress stair module 560 can be connected to portions of MEP module 530. Egress stair module 560 can include an external staircase that allows one to traverse different levels of the modular housing system, access different system modules, access different housing modules, and/or access a portion of the MEP module 530.

Figure 9:
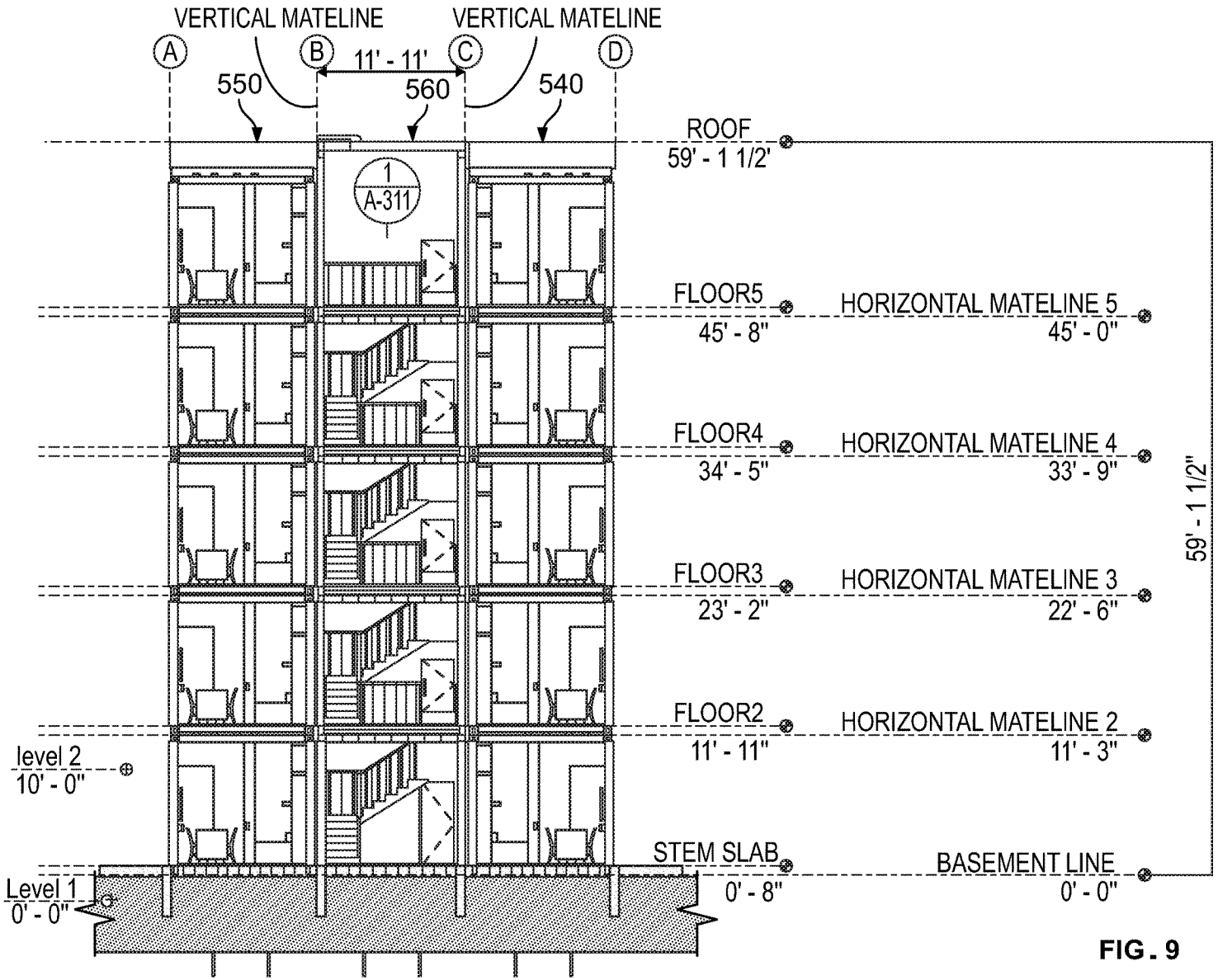
FIG. 9 shows an illustrative view showing the external stairs of the egress stair module between two stacked housing units in accordance with some embodiments of the disclosed subject matter.

FIG. 9 shows that egress stair module 560, when connected to MEP module 530 or any other suitable portion of the central system module, can be positioned between stacked housing unit 540 and stacked housing unit 550. For example, occupants of any of the housing modules in stacked housing unit 540 and stacked housing unit 550 can access egress stair module 560 to traverse different levels of the modular housing system, access different system modules, access different housing modules, and/or access a portion of the MEP module 530.

It should be noted that, as mentioned above, egress stair module 220 can be incorporated as a part of the central system module. For example, alternatively to connecting egress stair module 220 to a rear surface of MEP module 210 as shown in FIG. 2B, a first egress stair module in first prefabricated system module 104 can include exterior exit stairways, ramps, and/or platforms and a second egress stair module in second prefabricated system module 106 can include exterior exit stairways, ramps, and/or platforms, where, upon connecting first prefabricated system module 104 to second prefabricated system module 106 using one or more fasteners, the corresponding exterior exit stairways, ramps, and/or platforms can be connected to allow occupants of the modular housing system to reach a ground level from each level of the modular housing system.

In some embodiments, the modular housing system can include an elevator module. For example, as shown in FIG. 2C, an elevator module 230, which can include one or more elevator shafts, one or more elevator cars, elevator control units, elevator rails, etc., can be connected to a front perimeter portion of the central system module. For example, elevator module 230 can include fittings on a perimeter surface of elevator module 230 that connect with corresponding fittings on a front perimeter surface of the central system module (e.g., on front perimeter surfaces of each prefabricated system module). In another example, risers, conduits, and other system elements can be positioned in the interior area between elevator module 230 and the central system module.

Elevator module 230 can be used to provide, for example, transport people and/or freight (e.g., packages) between different levels of the prefabricated housing modules. Additionally or alternatively, elevator module 230 can include a wheelchair lift, a freight elevator, an escalator, a dumbwaiter, etc. In some embodiments, elevator module 230 can include an elevator system for transporting passengers and/or freight between different levels of the prefabricated housing modules and a separate dumbwaiter system for transporting packages between different levels of the prefabricated housing modules. In some embodiments, elevator module 230 can be omitted.

It should be noted, although the embodiments described herein generally show elevator module 230 as being cuboid-shaped, this is merely illustrative and elevator module 230 can be any suitable shape (e.g., cylindrical).

It should also be noted that, as mentioned above, elevator module 230 can be incorporated as a part of the central system module. For example, alternatively to connecting elevator module 230 to a front surface of the central system module as shown in FIG. 2C, a first elevator module in first prefabricated system module 104 can include one or more elevator shafts, elevator control units, elevator rails, etc. and a second egress stair module in second prefabricated system module 106 can include one or more elevator shafts, elevator control units, elevator rails, etc., where, upon connecting first prefabricated system module 104 to second prefabricated system module 106 using one or more fasteners, the corresponding elevator shaft and elevator components can be connected to allow one or more elevator cars to transport occupants and/or freight between different levels of the modular housing system.

It should further be noted that, although the embodiments described herein mention a central system module with an elevator module connected to one end of the central system module (e.g., on the front perimeter surface) and a MEP module connected to the opposing end of the central system module (e.g., on the opposing rear perimeter surface), this is merely illustrative. In some embodiments, each prefabricated system module within the central system module can include a MEP portion, an elevator portion, and/or an egress stairway portion. In this example, each prefabricated system module can be vertically aligned and connected to form the central system module having these components. In addition, in such an embodiment, different prefabricated system modules can be used in the central system module based on, for example, the corresponding prefabricated housing module. For example, a first prefabricated housing module may wish to have particular electrical connections, while a second prefabricated housing module may wish to have particular plumbing connections. In another example, a first prefabricated housing module can remove and replace a corresponding system module with an upgraded system module.

In some embodiments, the modular housing system can include multiple prefabricating housing modules that are vertically aligned with each other and joined with fasteners to form at least one stacked housing unit. For example, as shown in FIGS. 3A-3F, the modular housing system can include multiple prefabricated housing modules that are vertically aligned and joined with fasteners to form two stacked housing units on opposing ends of the central system module. In a more particular example, as shown in FIGS. 3A-3F, each stacked housing unit can include five prefabricated housing modules in which an upper perimeter portion of the lowest prefabricated housing module is connected with a lower perimeter portion of an adjacent prefabricated housing module using a fastener or any other suitable joining mechanism.

Figure 3A:
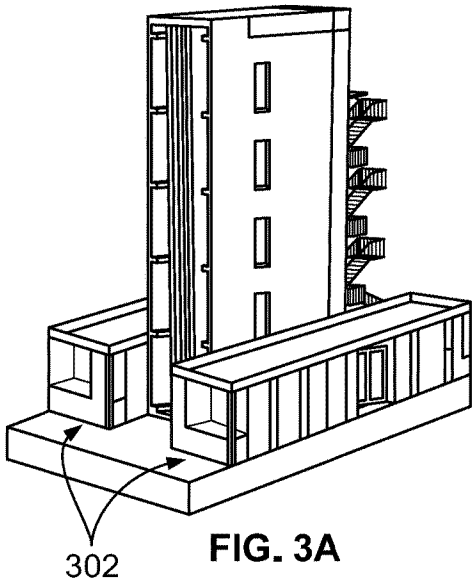
FIGS. 3A-3F show illustrative examples of a process for constructing a modular housing arrangement in which multiple prefabricated housing modules are vertically positioned on one another to form two stacked housing units and connected to the central system module, the MEP module, the egress stair module, and the elevator module in accordance with some embodiments of the disclosed subject matter.

As shown in FIG. 3A, a first set of prefabricated housing modules 302 can be positioned on foundation 102 and connected to foundation 102 and corresponding prefabricated system module 104. In continuing this example, each of the first set of prefabricated housing modules 302 can also be connected to a corresponding portion of MEP module 210, egress stair module 220, and/or elevator module 230.

In a more particular example, as shown in FIGS. 5 and 6, a top-down view of one level of the modular housing system shows that a first prefabricated housing module 540 and a second prefabricated housing module 550 can both be connected to a corresponding portion of a system module 510, a corresponding portion of an MEP module 530, a corresponding portion of an elevator module 520, and/or a corresponding portion of an egress stair module 560.

Figure 3B:
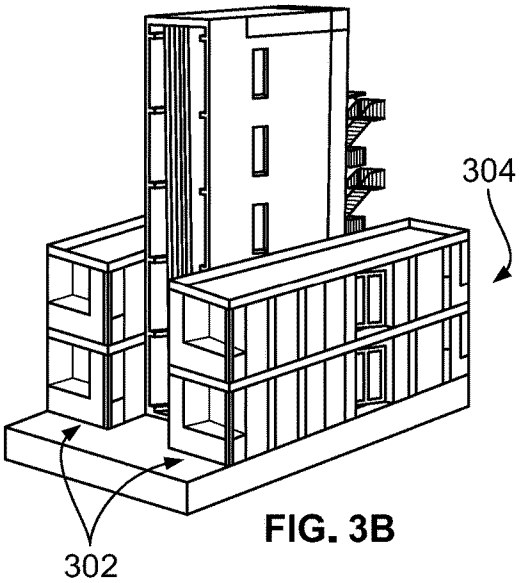

As shown in FIG. 3B, a second set of prefabricated housing modules 304 can be vertically aligned and positioned on first set of prefabricated housing modules 302 and connected to each of the first set of prefabricated housing modules 302 and corresponding prefabricated system module 106. In a more particular example, an upper perimeter portion of one of first prefabricated housing modules 302 can be aligned and connected with a lower perimeter portion of one of second prefabricated housing modules 304. Illustrative examples of fasteners or connectors that connect at least two prefabricated housing modules are further shown in FIGS. 10 and 11. In continuing this example, each of the second set of prefabricated housing modules 304 can also be connected to a corresponding portion of MEP module 210, egress stair module 220, and/or elevator module 230.

Figure 3C:
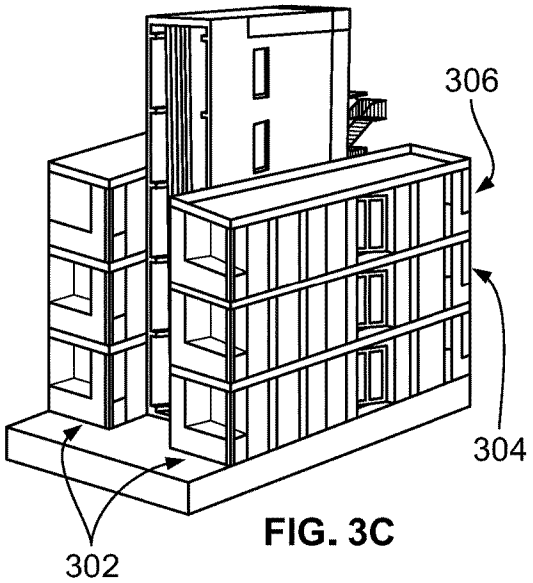

As shown in FIG. 3C, a third set of prefabricated housing modules 306 can be vertically aligned and positioned on second set of prefabricated housing modules 304 and connected to each of the second set of prefabricated housing modules 304 and corresponding prefabricated system module 108. In a more particular example, an upper perimeter portion of second prefabricated housing module 304 can be aligned and connected with a lower perimeter portion of third prefabricated housing module 306. In continuing this example, each of the third set of prefabricated housing modules 306 can also be connected to a corresponding portion of MEP module 210, egress stair module 220, and/or elevator module 230.

It should be noted that, in some embodiments, one of prefabricated housing modules 304 can be removed and/or replaced with another prefabricated housing module. For example, one of second prefabricated housing modules 304 can be replaced with a third prefabricated housing module 306 (e.g., an upgraded housing module, a housing module having a different layout, a housing module having a different number of bedrooms, etc.). In a more particular example, second prefabricated housing modules 304 can be disconnected from first prefabricated housing module 302 and, using a crane, second prefabricated housing modules 304 can be removed and replaced with third prefabricated housing module 306, which may include updated features for use with a prefabricated system module 106 that is connected to and horizontally adjacent to third prefabricated housing module 308 (e.g., an upgraded housing module that is capable of using features in prefabricated system module 106).

Figure 3D:
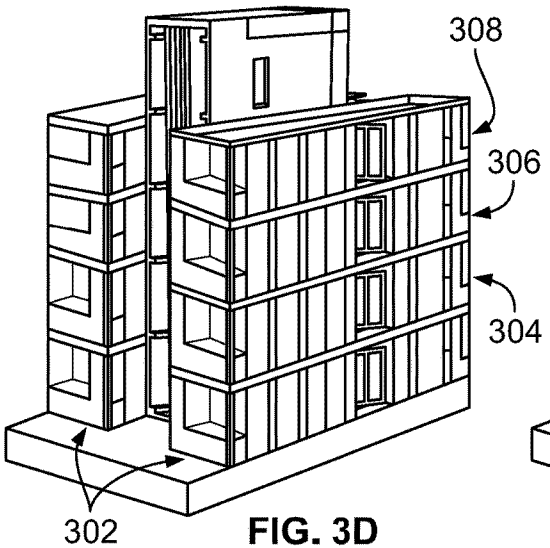

In continuing the above-mentioned example, as shown in FIG. 3D, a fourth set of prefabricated housing modules 308 can be vertically aligned and positioned on third set of prefabricated housing modules 306 and connected to each of the third set of prefabricated housing modules 306 and corresponding prefabricated system module 110. In a more particular example, an upper perimeter portion of one of third prefabricated housing modules 306 can be aligned and connected with a lower perimeter portion of one of fourth prefabricated housing modules 308. In continuing this example, each of the fourth set of prefabricated housing modules 308 can also be connected to a corresponding portion of MEP module 210, egress stair module 220, and/or elevator module 230.

Figure 3E:
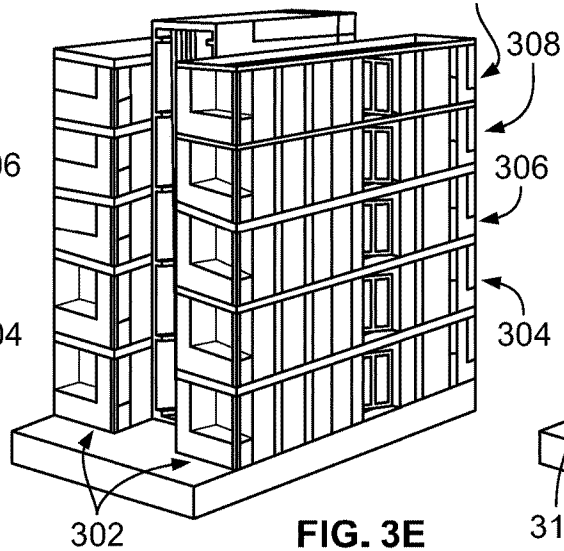

As shown in FIG. 3E, a fifth set of prefabricated housing modules 310 can be vertically aligned and positioned on fourth set of prefabricated housing modules 308 and connected to each of the fourth set of prefabricated housing modules 308 and corresponding prefabricated system module 112. In a more particular example, an upper perimeter portion of one of fourth prefabricated housing module 308 can be aligned and connected with a lower perimeter portion of one of fifth prefabricated housing module 112. In continuing this example, each of the fifth set of prefabricated housing modules 310 can also be connected to a corresponding portion of MEP module 210, egress stair module 220, and/or elevator module 230.

Figure 3F:
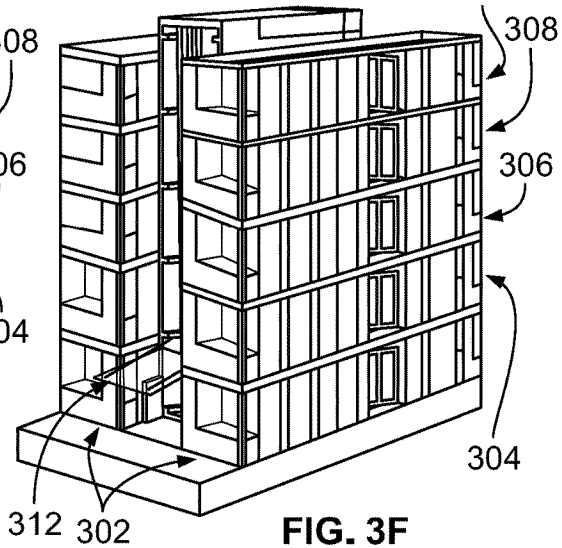

In some embodiments, a roof portion (not shown) can be connected to an upper perimeter portion of the uppermost prefabricated housing module. For example, a roof portion can be connected to the upper perimeter portion of each of fifth prefabricated housing modules 310. It should be noted that, in some embodiments, the roof portion can be disconnected from fifth prefabricated housing module 310 to, for example, insert one or more additional prefabricated housing modules or remove one or more currently installed housing modules. It should be noted that, in some embodiments, the roof portion can be omitted from the stacked housing units as shown in FIG. 3F.

Figure 10:
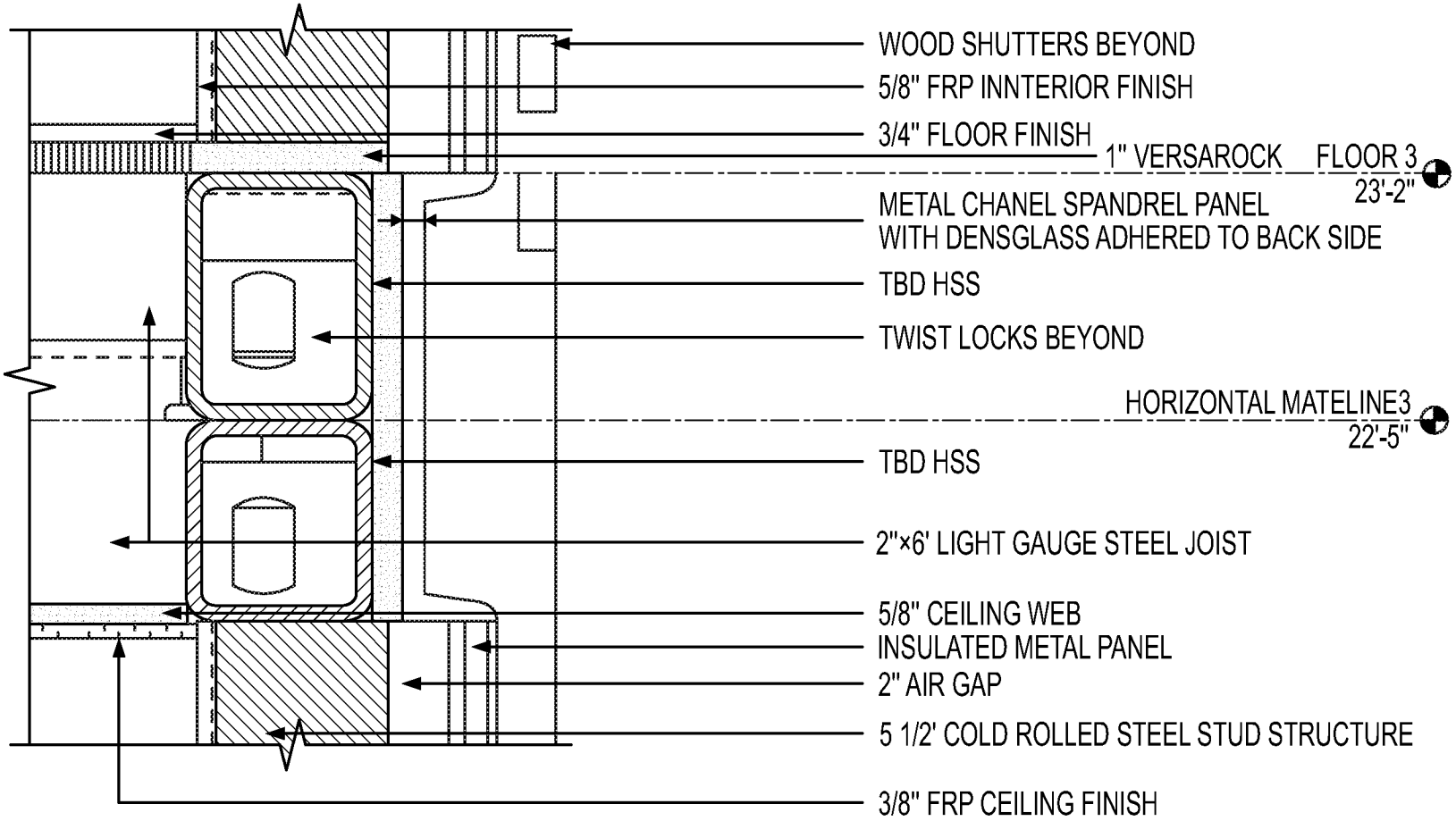
FIG. 10 shows an illustrative cross-sectional view of two prefabricated housing modules that are connected using a fastening mechanism (e.g., twistlocks between portions on adjacent housing modules) in accordance with some embodiments of the disclosed subject matter.
Figure 11:
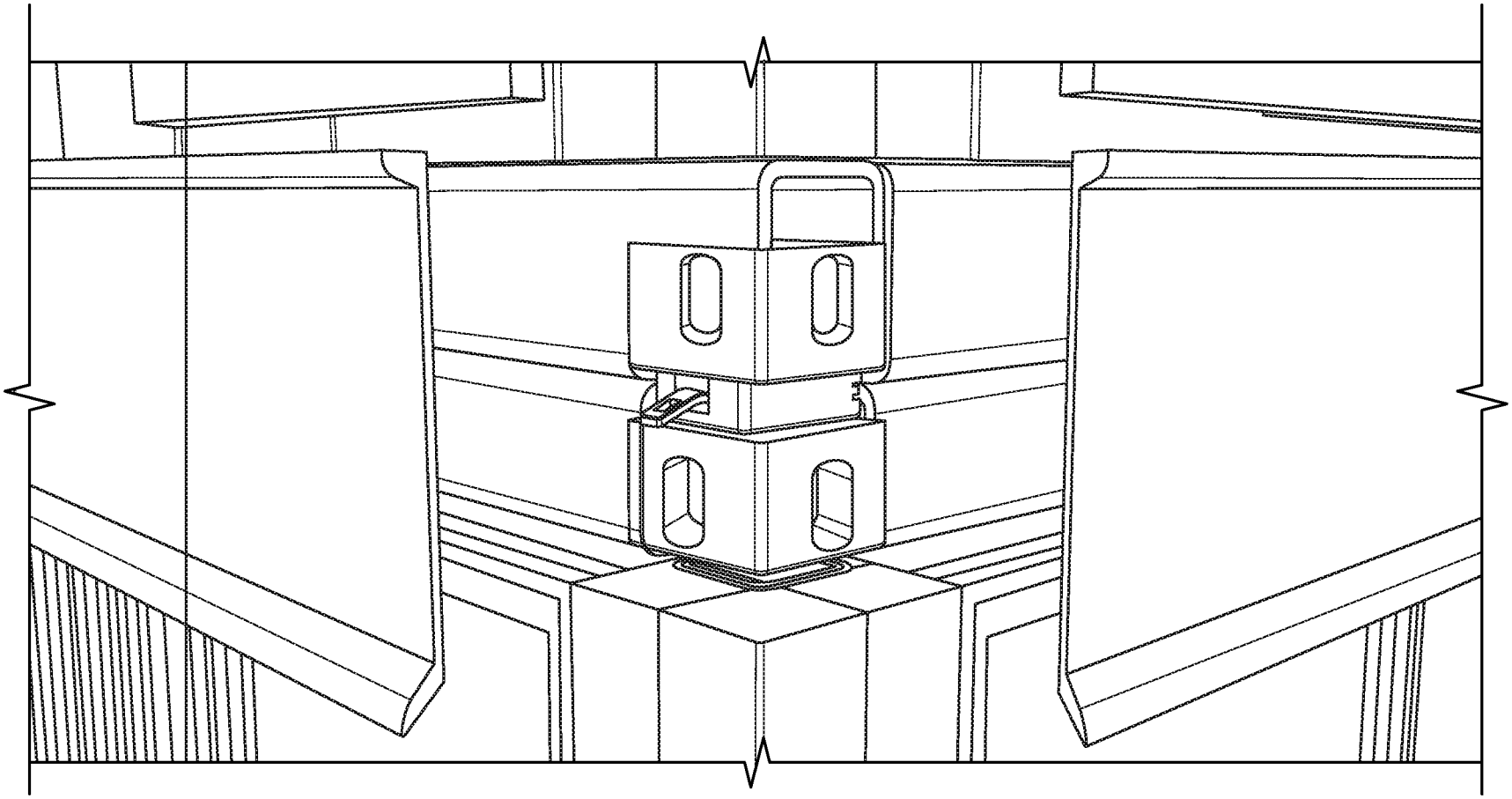
FIG. 11 shows an illustrative schematic of the fastening mechanism used to connect two adjacent prefabricated housing modules in accordance with some embodiments of the disclosed subject matter.

As described herein, the prefabricated housing modules can be connected to form a stacked housing unit. As also described herein, the prefabricating system modules can be connected to form the central system module. Adjacent modules can be aligned and twistlocks can be used interconnect and lock two adjacent modules. For example, as shown in FIGS. 1A-1F, each prefabricated system module can include multiple openings or fittings that receive corresponding portions of twistlocks on an adjacent prefabricated system module. Similarly, as shown in FIGS. 3A-3F, each prefabricated housing module can include multiple openings that receive corresponding portions of twistlocks on an adjacent prefabricated housing module. In a more particular example, as shown in FIGS. 10 and 11, a hollow structural section can be bolted or otherwise attached to an upper perimeter portion of a module and can include a receiving portion of a twistlock and a hollow structural section can be bolted on or otherwise attached to a lower perimeter portion of a module and can include an engaging portion of a twistlock. Such twistlocks can be used to lock adjacent modules together and/or release adjacent modules from one another.

Figure 12:
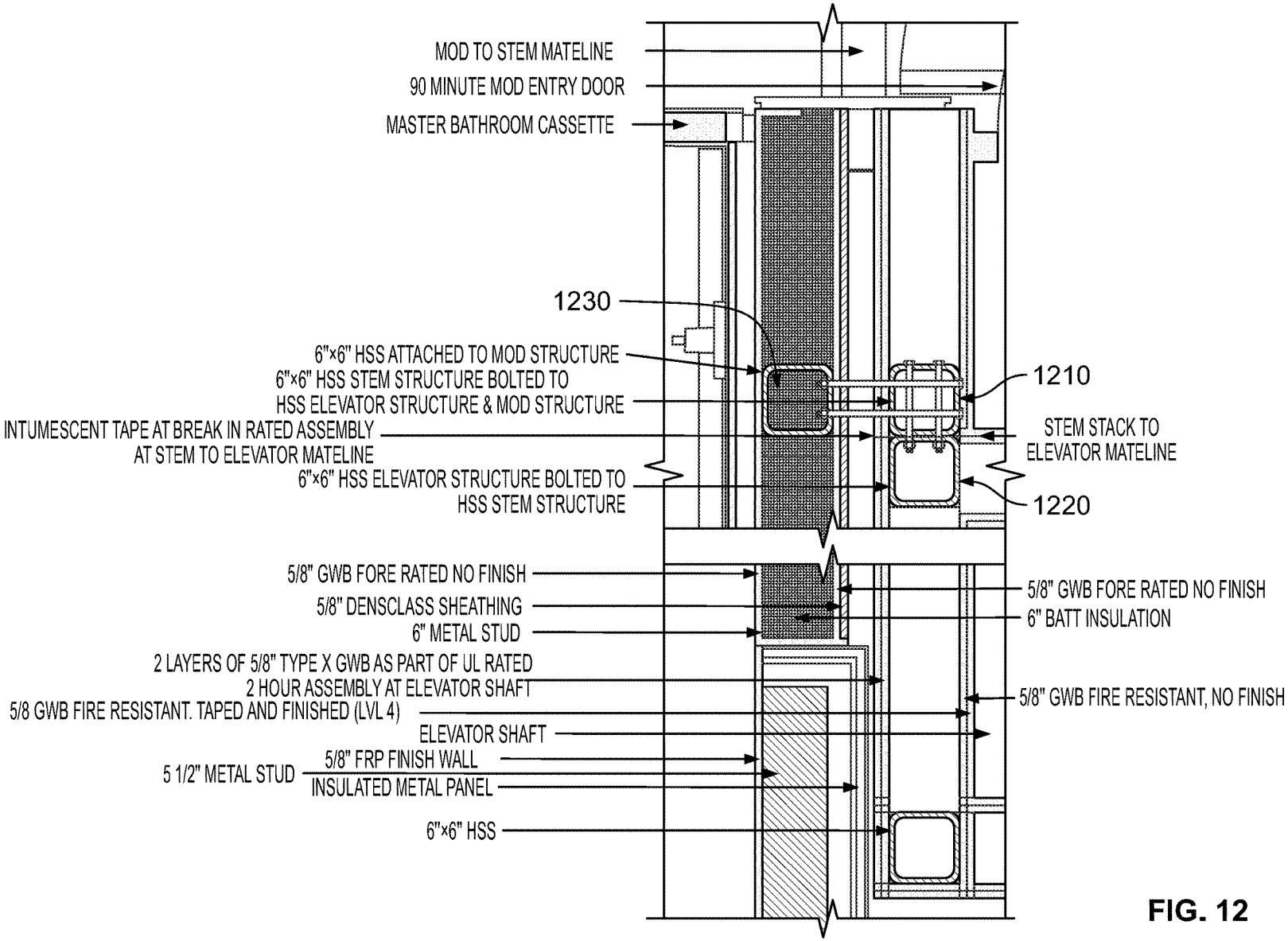
FIG. 12 shows an illustrative cross-sectional view of the fastening mechanism (e.g., bolts between hollow structural sections on modules) used to connect an elevator module, a prefabricated system module, and a prefabricated housing module in accordance with some embodiments of the disclosed subject matter.

It should be noted, however, that any suitable fastening mechanism for connecting stacked modules can be used. For example, each of the modules in the modular housing system can include any suitable fittings for connecting modules with one another. In a more particular example, upon placing a first prefabricated system module on a second prefabricated system module, the fittings on an upper perimeter surface of the first prefabricated system module and the fitting on a lower perimeter surface of the second prefabricated system module can engage to connect the first prefabricated system module and the second prefabricated system module to form a central system module. In continuing this example, additional fittings on a rear surface of the central system module and the fittings on a front surface of a MEP module can engage to connect the central system module with the MEP module and additional fittings on a front surface of the central system module and the fittings on a rear surface of an elevator module can engage to connect the central system module with the elevator module (e.g., having an elevator door that opens into a corresponding system module). In a more particular example, where different types of modules can be connected together, FIG. 12 shows that a hollow structural section 1210 of a system module (where hollow structural section 1210 can be bolted to a perimeter portion of the system module) can be bolted to a hollow structural section 1220 of an elevator module (where hollow structural section 1220 can be bolted to a perimeter portion of the elevator module) and the same hollow structural section 1210 of the system module can be bolted to a hollow structural section 1230 of a corresponding housing module (where hollow structural section 1230 can be bolted to a perimeter portion of the housing module). Further, additional fittings on perimeter surfaces of each prefabricated housing module can engage with (1) fittings on each prefabricated system module and (2) fittings on adjacent prefabricated housing modules. These fittings that are associated with each module can, for example, allow a module to be installed, removed, and/or replaced.

It should be noted that, in some embodiments, the prefabricated housing module and the corresponding prefabricated system module or other component modules (e.g., MEP module, elevator module, stair module, etc.) can be configured such that, when the housing module and the corresponding system module are connected together via pre-configured fittings, the system module can provide its support features to the housing module. For example, the corresponding system module can include plumbing risers that connect to a water source, where, upon connection to a housing module, the system module can connect to the plumbing of the housing module such that the fixtures and appliances of the housing modules are provided with water from the water source. In another example, the corresponding system module can include an elevator system having an elevator door that provides access to the housing module and other areas of the modular housing system.

In some embodiments, each of the prefabricated system modules and/or each of the prefabricated housing modules can be configured to facilitate disassembly of the modules. For example, the exterior walls (including, for example, the roof and/or base) of the modules can be constructed using frames that attach to and detach from each other using removable fasteners, such as screws, nuts, bolts, any other suitable removable fastener, or any suitable combination thereof.

In some embodiments, each of the system modules and/or each of the housing modules can be configured to facilitate transportation of the modules to and/or from off-site locations (e.g., locations where the prefabricated modules can be constructed and/or repaired). For example, the modules can be configured to be structurally rigid even when not fastened to a foundation, such that the modules can be lifted and moved onto a vehicle (e.g., a truck, ship, train, and/or helicopter) for transportation.

It should be noted that any suitable number of prefabricated housing modules can be connected to form a stacked housing unit. It should also be noted that, although FIGS. 3A-3F show two stacked housing units that each include five prefabricated housing modules, each stacked housing unit can include any suitable number of prefabricated housing modules (e.g., three prefabricated housing modules in one unit and five prefabricated housing modules in the other unit). It should further be noted that, although FIGS. 3A-3F show two stacked housing units that each include five prefabricated housing modules, only one stacked housing unit can be formed and connected to the central system module. Accordingly, the modular housing system can include any suitable combination of prefabricated housing modules, stacked housing units, the central system module, the MEP module, the egress stair module, and/or the elevator module.

Figure 4A:
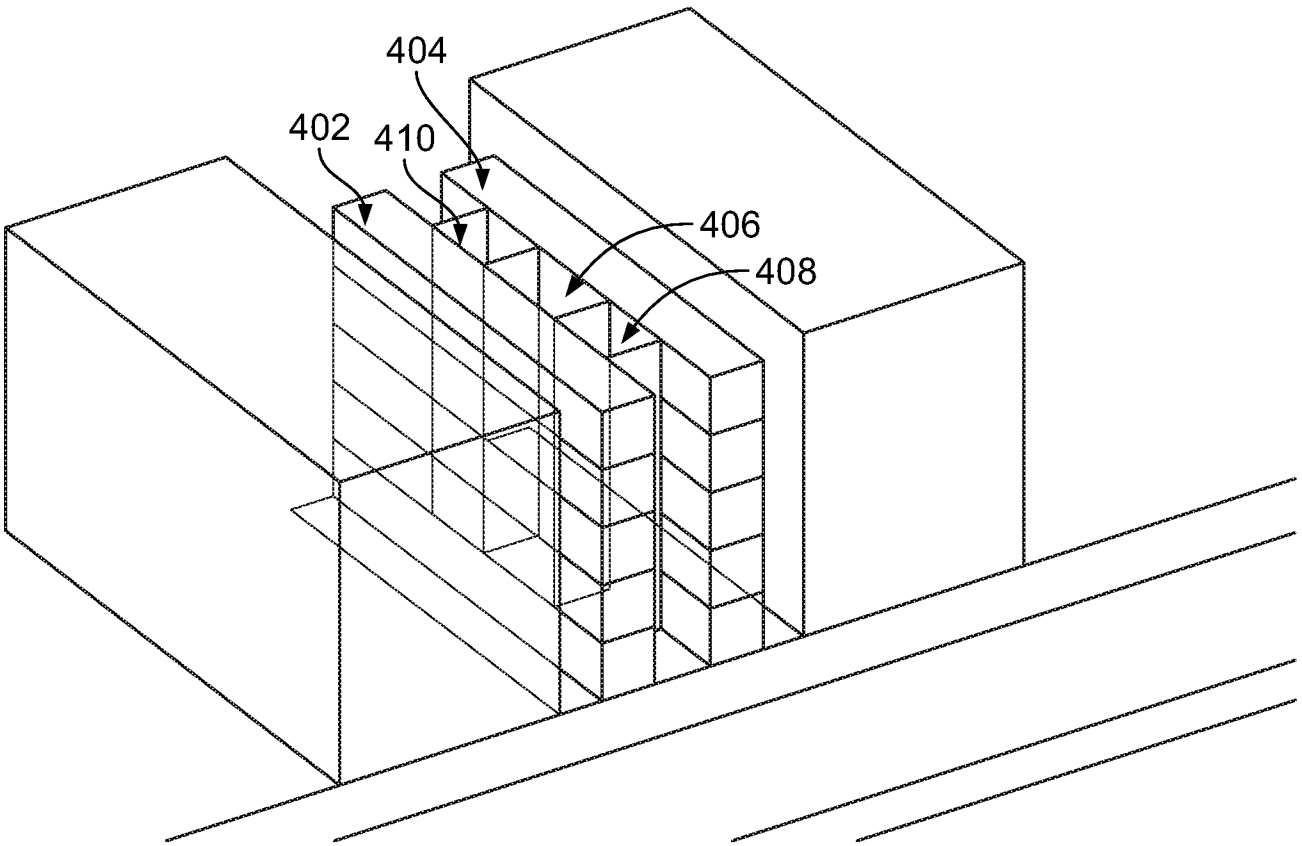
FIGS. 4A-4F show illustrative examples of alternative configurations of the modular housing arrangement in accordance with some embodiments of the disclosed subject matter.
Figure 4B:
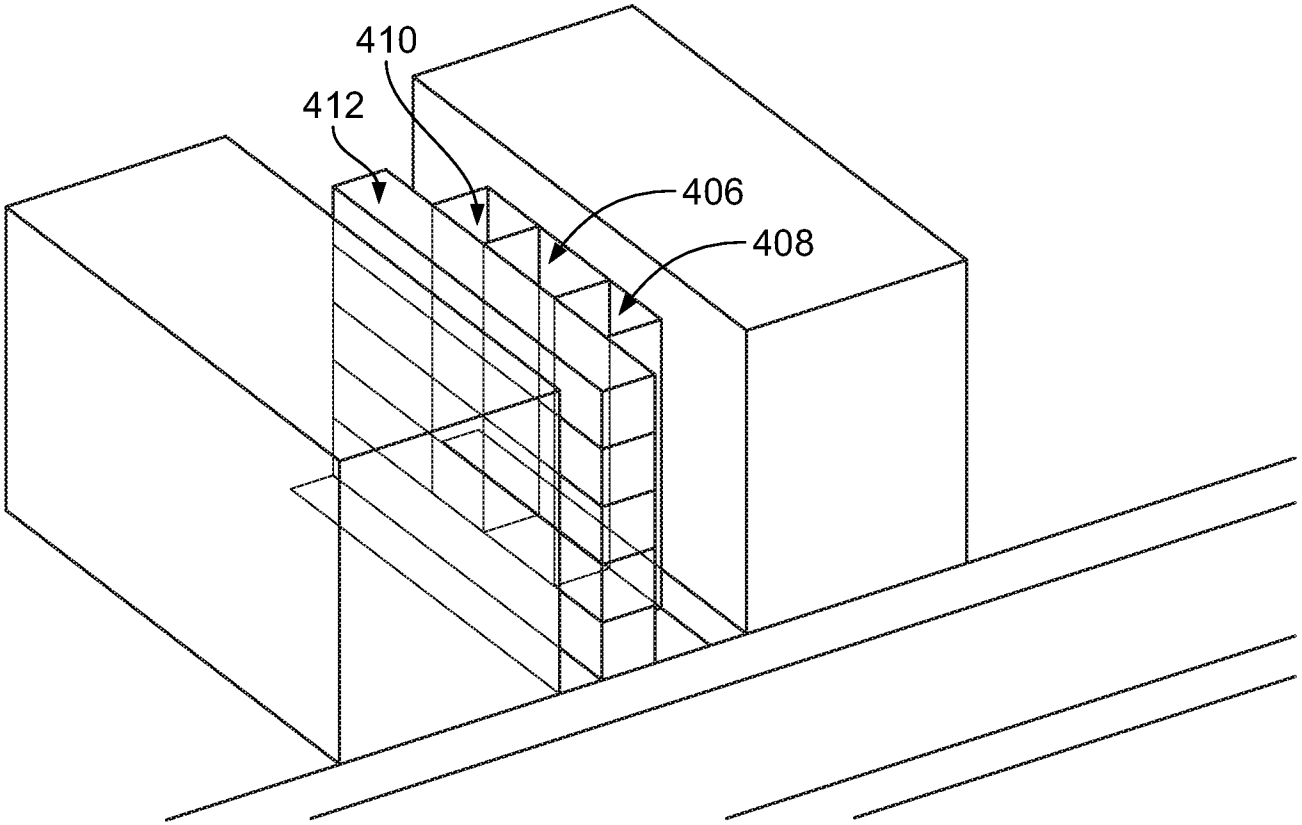

For example, FIG. 4A shows an example of an illustrative modular housing system that includes a first stacked housing unit 402 that includes five prefabricated housing modules that are connected to each other and a second stacked housing unit 404 that also includes five prefabricated housing modules that are connected to each other, where the first stacked housing unit 402 and the second stacked housing unit 404 are connected to a central system module 406 that includes a set of stairs and other connectors (e.g., mechanical, electrical, and plumbing connectors), an elevator module 408, and an egress stair module 410 that includes a set of external stairs. Alternatively, FIG. 4B shows an illustrative modular housing system that includes a single stacked housing unit 412 that includes five prefabricated housing modules that are connected to each other, where the single stacked housing unit 412 is connected to a central system module 406 that includes a set of stairs and other connectors (e.g., mechanical, electrical, and plumbing connectors), an elevator module 408, and an egress stair module 410 that includes a set of external stairs.

Figure 4C:
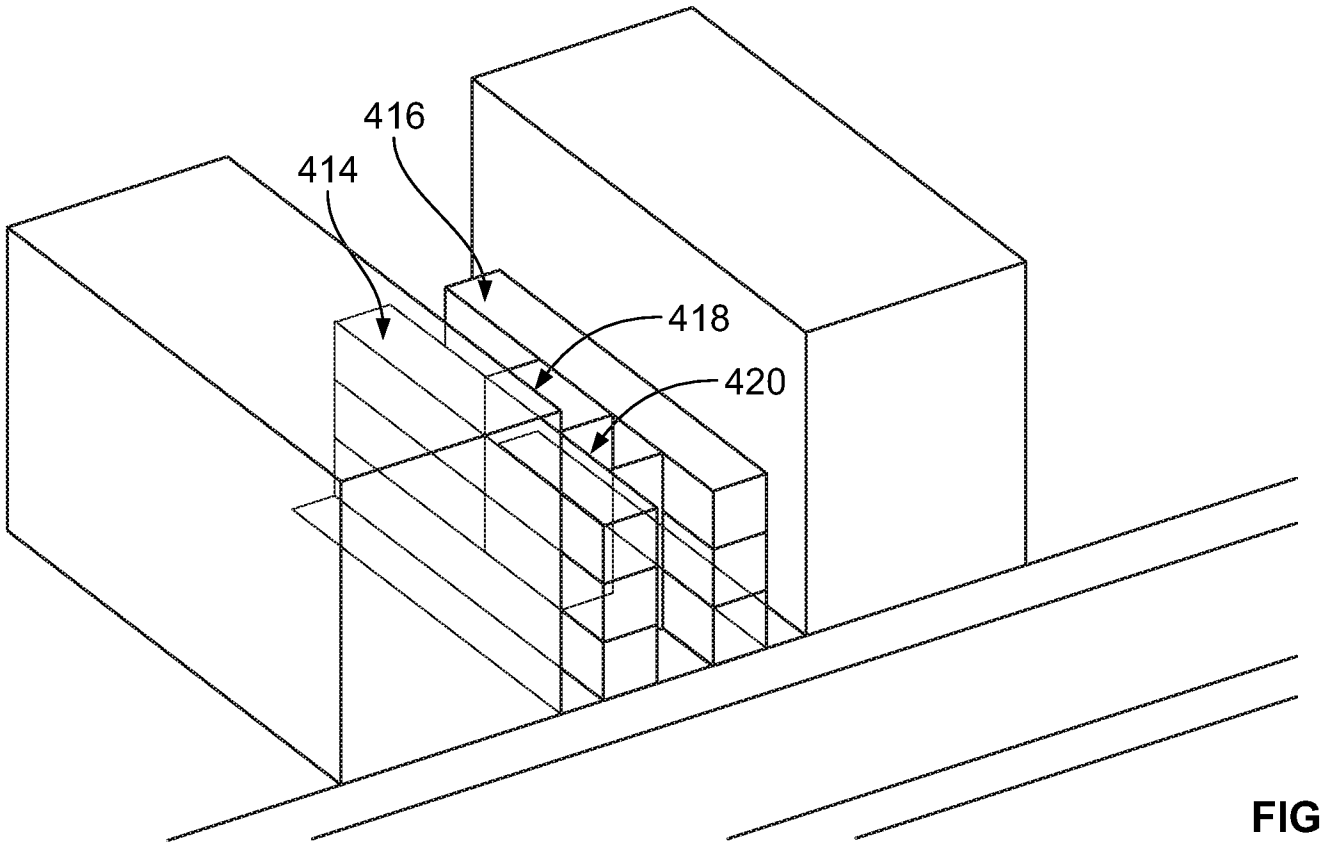
Figure 4D:
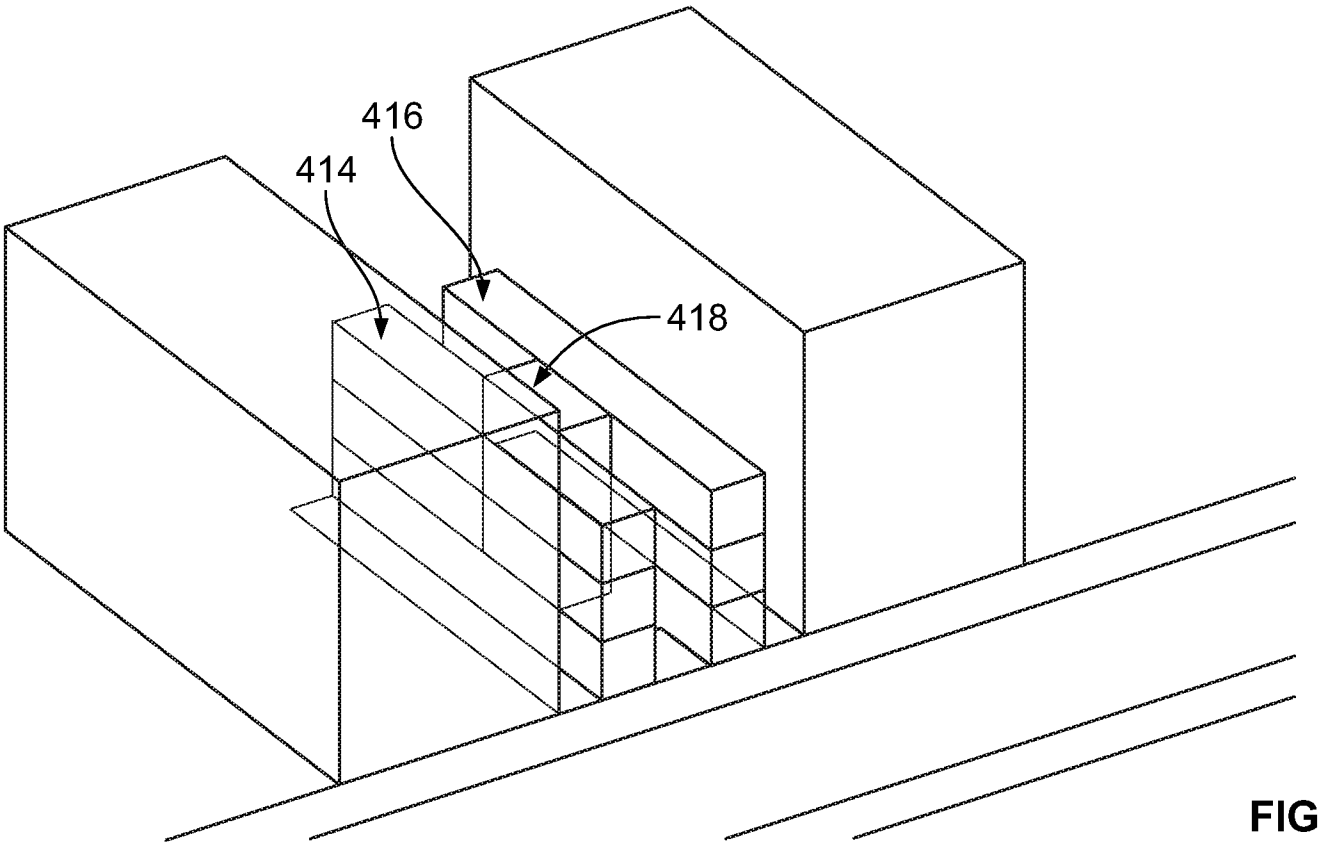

In another example, FIG. 4C shows an example of an illustrative modular housing system that includes a first stacked housing unit 414 that includes three prefabricated housing modules that are connected to each other and a second stacked housing unit 416 that also includes three prefabricated housing modules that are connected to each other, where the first stacked housing unit 414 and the second stacked housing unit 416 are connected to a central system module 418 that includes a set of stairs and other connectors (e.g., mechanical, electrical, and plumbing connectors) and an elevator module 420. Alternatively, FIG. 4D shows an example of an illustrative modular housing system that includes a first stacked housing unit 414 that includes three prefabricated housing modules that are connected to each other and a second stacked housing unit 416 that also includes three prefabricated housing modules that are connected to each other, where the first stacked housing unit 414 and the second stacked housing unit 416 are connected to a central system module 418 that includes a set of stairs and other connectors (e.g., mechanical, electrical, and plumbing connectors).

Figure 4E:
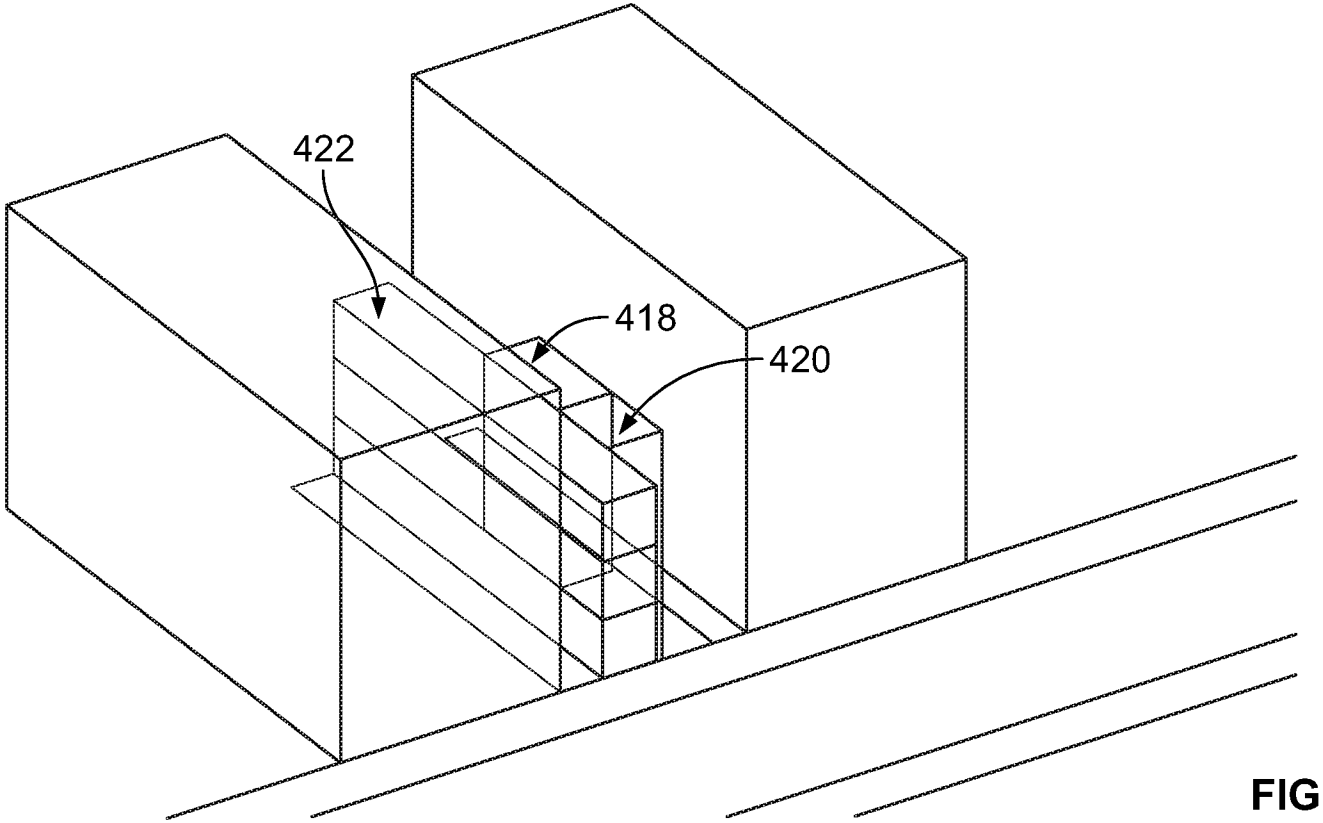

In yet another example, FIG. 4E shows an illustrative modular housing system that includes a single stacked housing unit 422 that includes three prefabricated housing modules that are connected to each other, where the single stacked housing unit 422 is connected to a central system module 418 that includes a set of stairs and other connectors (e.g., mechanical, electrical, and plumbing connectors) and an elevator module 408.

Figure 4F:
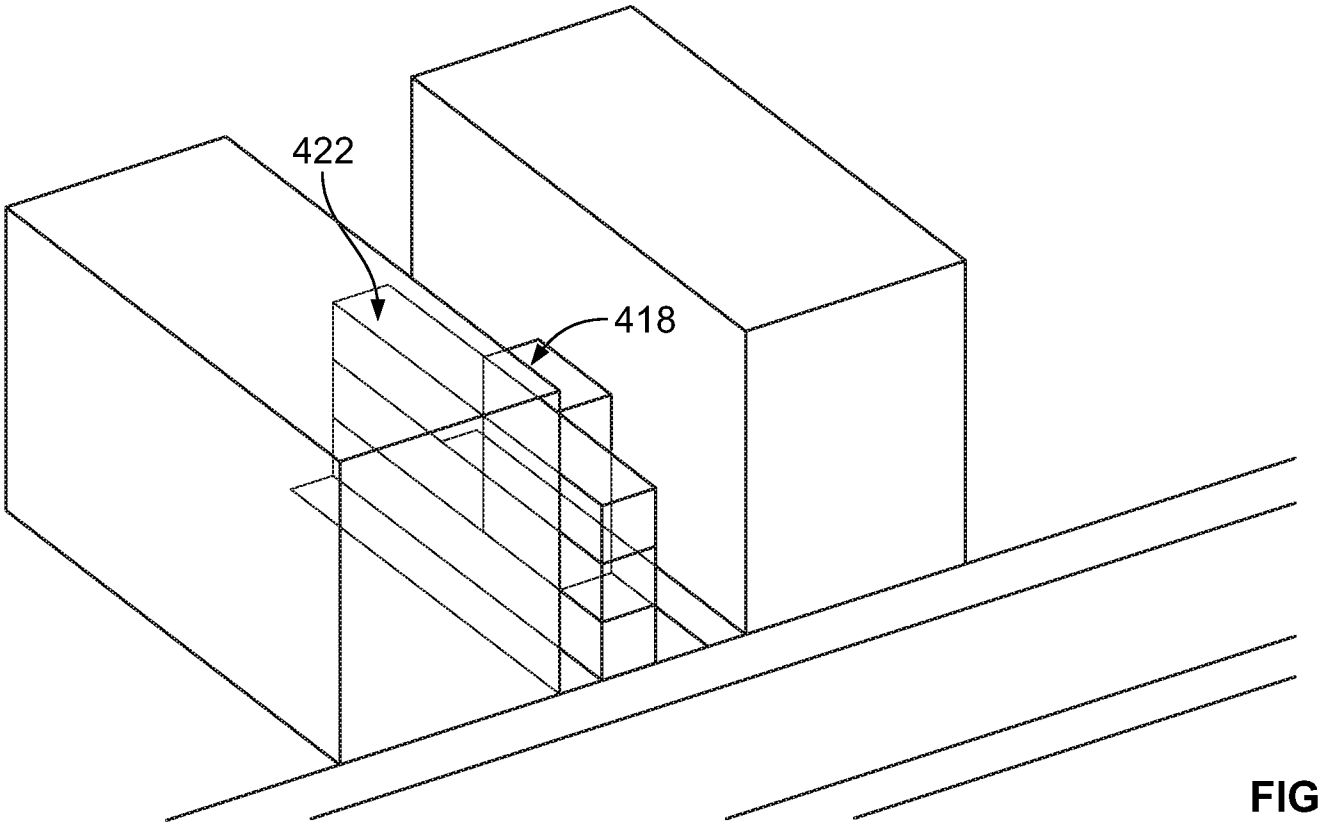

In a further example, FIG. 4F shows an illustrative modular housing system that includes a single stacked housing unit 422 that includes three prefabricated housing modules that are connected to each other, where the single stacked housing unit 422 is connected to a central system module 418 that includes a set of stairs and other connectors (e.g., mechanical, electrical, and plumbing connectors).

Figure 8:
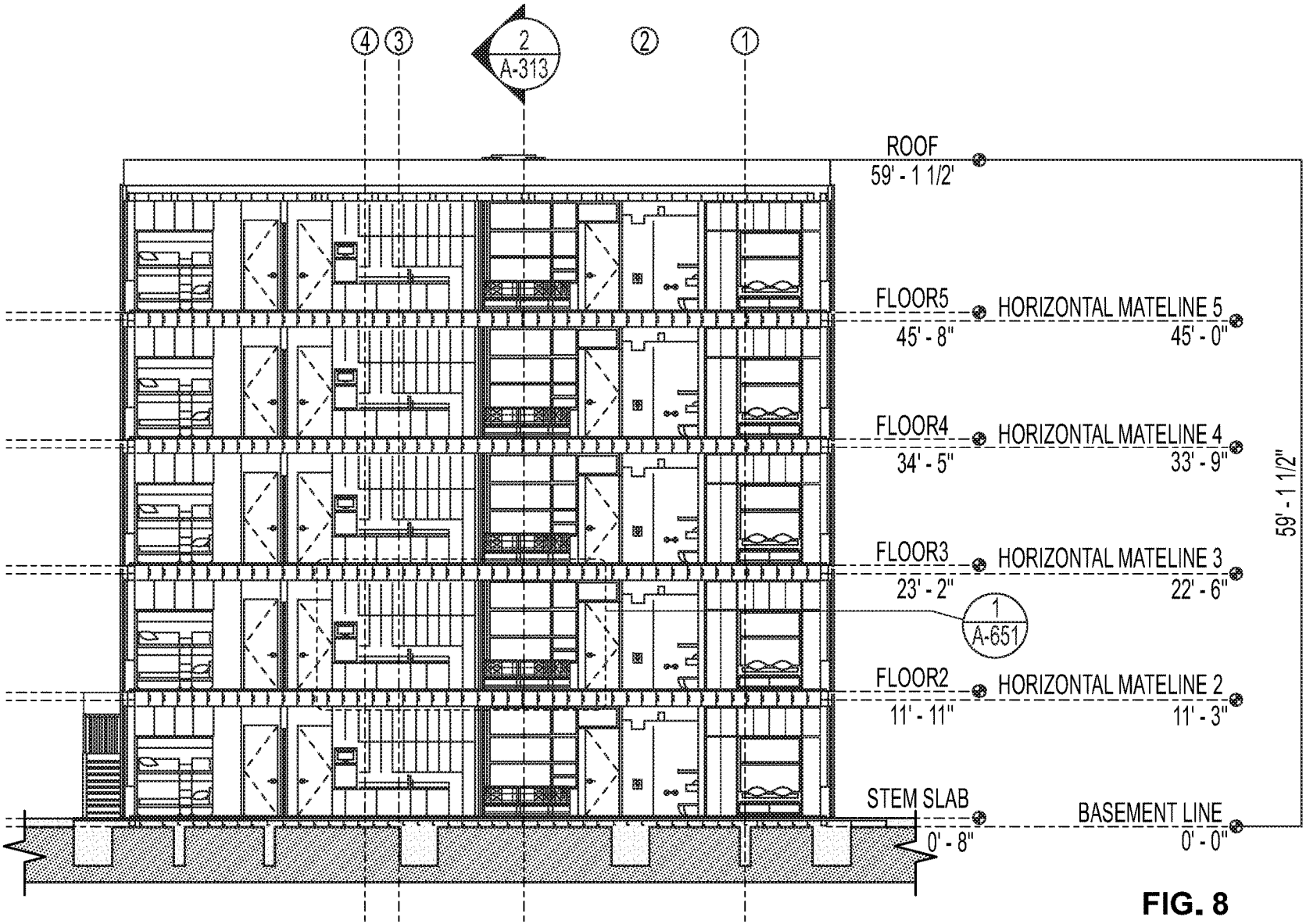
FIG. 8 shows an illustrative view of the interior of multiple prefabricated housing modules in a stacked housing unit in accordance with some embodiments of the disclosed subject matter.
Figure 13:
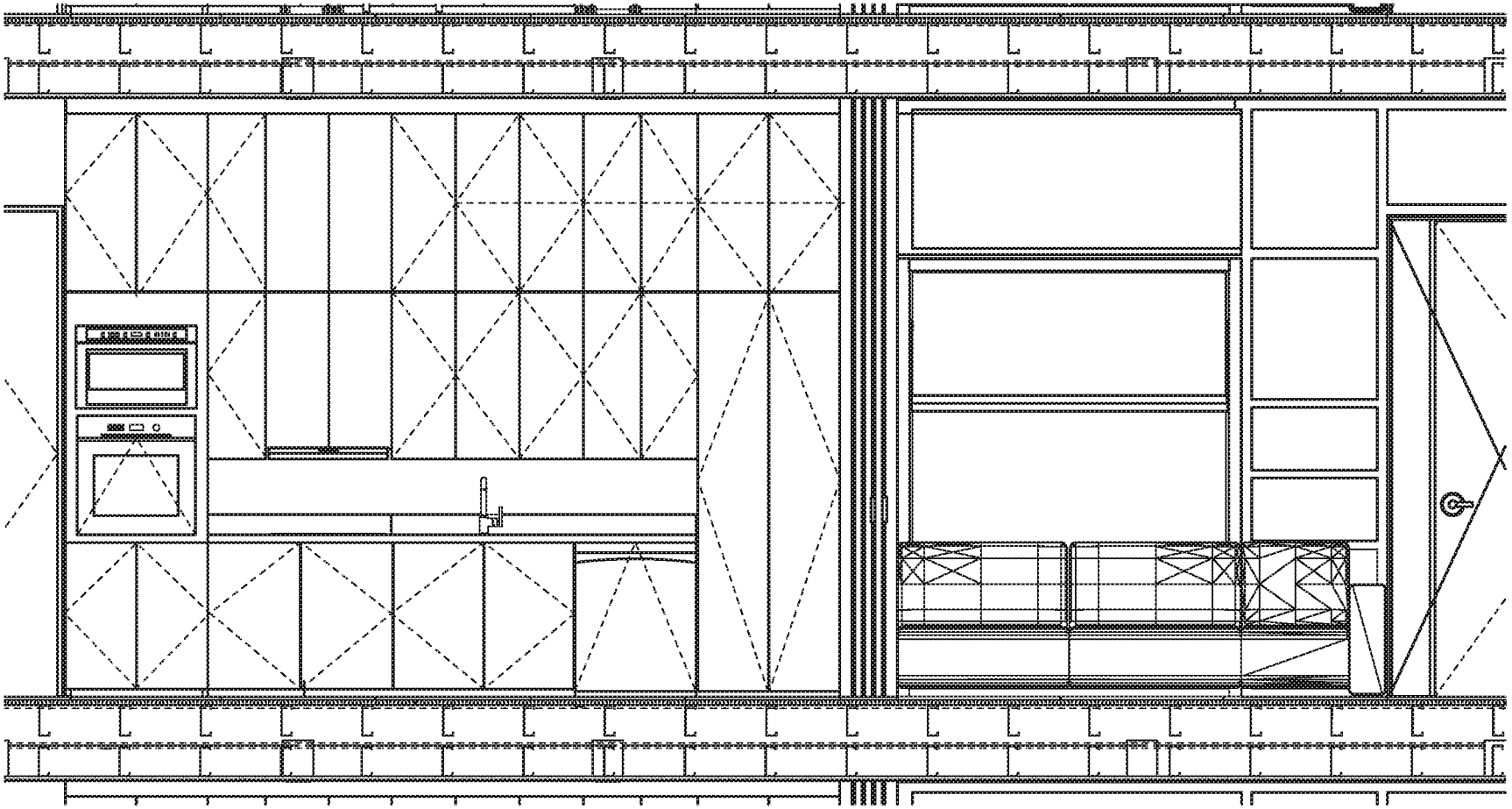
FIG. 13 shows an illustrative example of a kitchen cassette and a dining area cassette installed along a shell portion of a housing module in accordance with some embodiments of the disclosed subject matter.

It should be noted that each prefabricated housing module in the modular housing system can be have any suitable layout. For example, as shown in FIG. 8, each modular housing system in a stacked housing unit is shown to have the same layout. In another example, each modular housing system in a stacked housing unit can have one of multiple layouts. For example, as shown in FIG. 13, a kitchen area in a particular prefabricated housing module is positioned adjacent to a dining area. In another example, a prefabricated housing module can include living areas, such as a bedroom, a living room, a bathroom, a kitchen, a common room, an office, a terrace, a gym, a laundry room, a playroom, a storage room, an entertainment room, any suitable combination thereof, etc. In yet another example, a prefabricated housing module can include one or more connectors for providing water, hot water, electricity, sewage, and/or HVAC from a corresponding prefabricated system module or MEP module to appliances and other systems within the prefabricated housing module.

In some embodiments, the prefabricated housing module can be configured such that each of its rooms are connected without hallways. For example, the prefabricated housing module can be configured such that each of its interior walls includes a doorway. As another example, each room can be connected to an adjacent room via a doorway.

In some embodiments, the prefabricated housing module can include any suitable systems and/or appliances. For example, the prefabricated housing module can include refrigerators, ovens, sinks, tubs, air conditioning units, water heaters (e.g., point of use heaters), heat pumps, solar panels, any other suitable systems and/or appliances, or any suitable combination thereof.

It should be noted that each prefabricated housing module in a modular housing arrangement can be arranged in any suitable manner. For example, FIG. 14 and FIGS. 15A-15F show an illustrative arrangement that can be used for one or more prefabricated housing modules. More particularly, FIGS. 15A-15F shows an illustrative arrangement having two bedrooms with each bedroom on opposing ends of the prefabricated housing module.

In some embodiments of the disclosed subject matter, a prefabricated housing module can be configured by sliding one or more cassettes into a prefabricated housing module and attaching each cassette to a wall or shell portion of the prefabricated housing module. This can, for example, allow connections between appliances in the prefabricated housing module to be made with the appropriate connectors in the MEP module.

Figure 14:
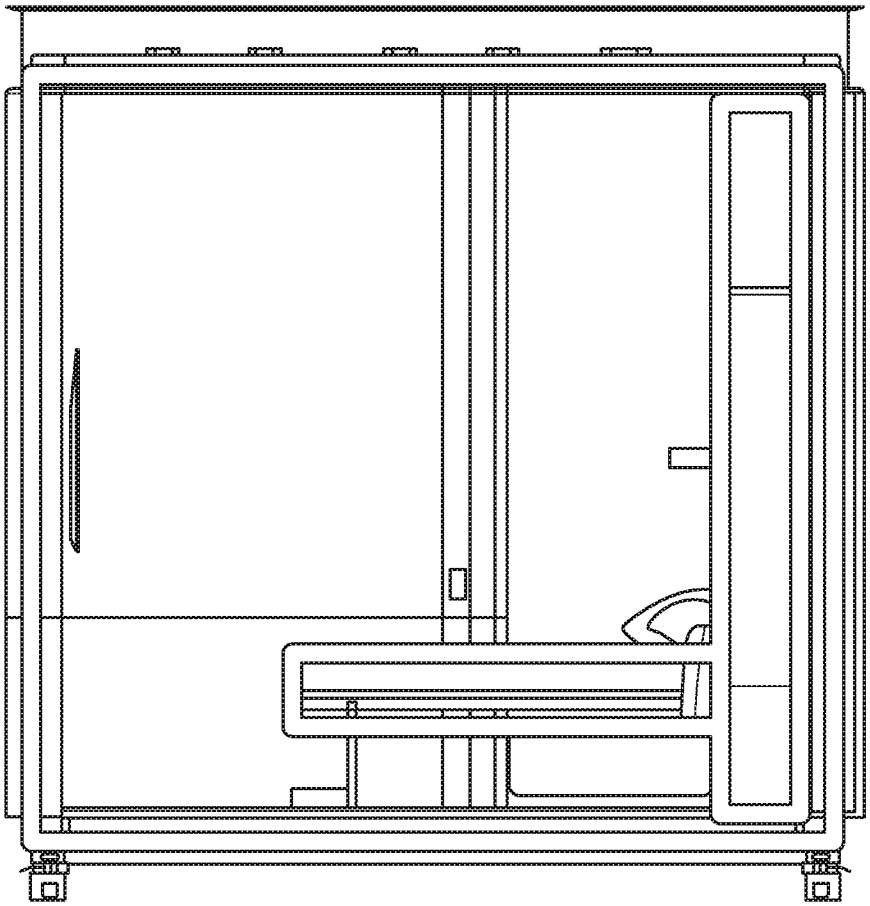
FIG. 14 shows an illustrative example of a bedroom cassette connected to a shell portion of a housing module in accordance with some embodiments of the disclosed subject matter.

For example, FIG. 14 shows an illustrative cross-sectional view of a prefabricated housing module in which a bedroom cassette has been installed. As shown in FIG. 14, a bedroom cassette 1410 that can include a substantially flat portion that corresponds with the height of the prefabricated housing module can be positioned along a shell portion 1420 of the prefabricated housing module (e.g., at a location in which the occupant desires a bedroom). It should be noted that bedroom cassette 1410 can include any suitable bedroom furniture, such as one or more beds, one or more dressers, one or more nightstands, etc. that are formed along an edge of the cassette. It should also be noted that bedroom cassette 1410 can have dimensions that allow bedroom cassette 1410 to be moved from an open end of the prefabricated housing module and through the prefabricated housing module until reaching its position along the shell portion 1420 of the prefabricated housing module. It should further be noted that, in some embodiments, bedroom cassette 1410 and other cassettes described herein can be attached to a suitable portion of shell 1420.

In some embodiments, each cassette can be connected along an edge portion or shell portion of the prefabricated housing module, where the edge portion or shell portion of the prefabricated housing module can include connectors to water, electrical, HVAC, vacuum, or other systems positioned along an area proximal to the connection point with the corresponding system module. For example, the connectors between a prefabricated housing portion and a corresponding prefabricated system module (or MEP module) can be positioned along the lower, central adjoining wall of the prefabricated housing module.

Figure 15A:
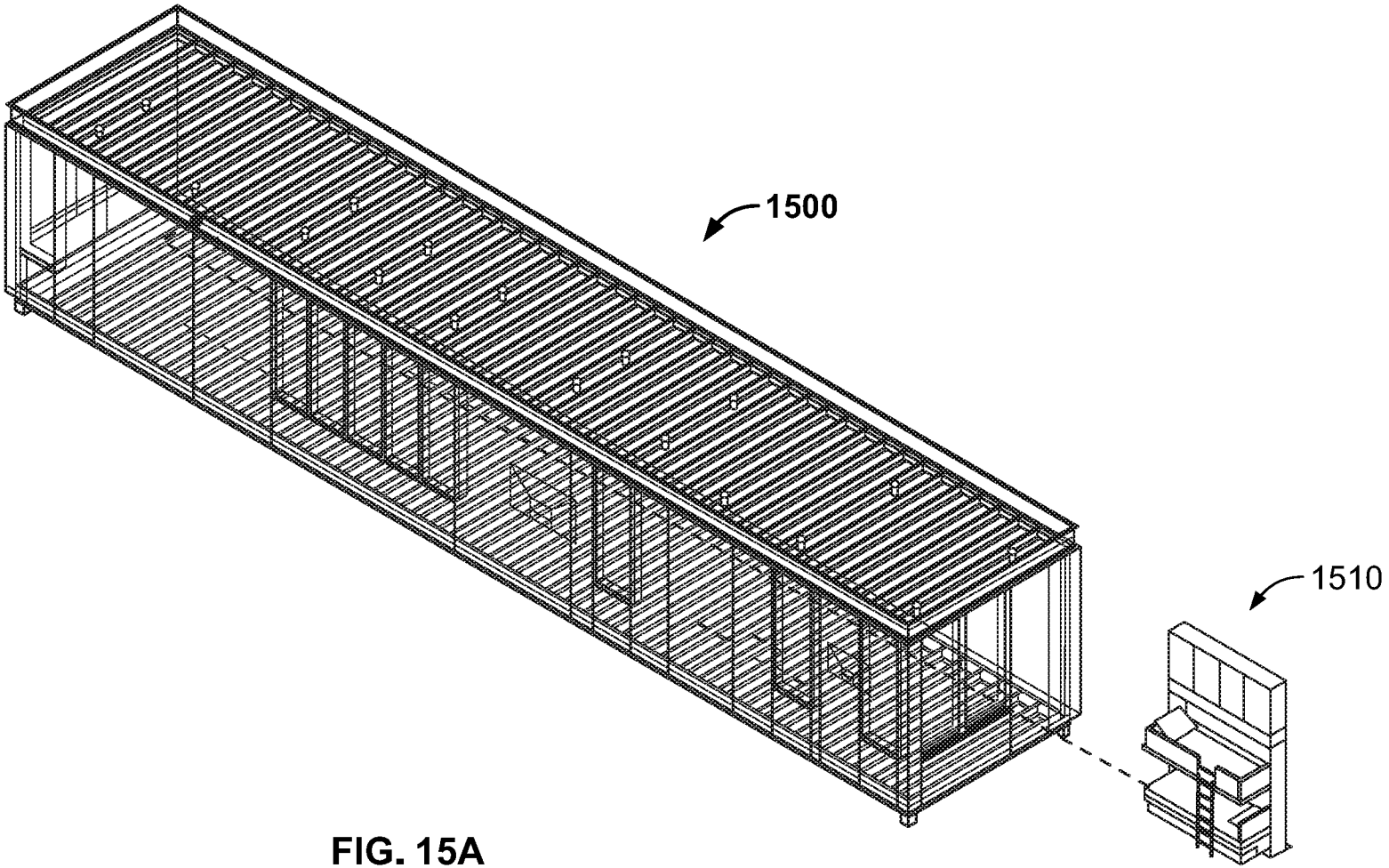
FIG. 15A shows an illustrative example of a bedroom cassette being slid through a housing module and being connected to a shell portion of the housing module in accordance with some embodiments of the disclosed subject matter.

In a more particular example, FIG. 15A shows an illustrative example of a prefabricated housing module 1500 having particular dimensions. As shown in FIG. 15A, a bedroom cassette 1510 (e.g., including bedroom furniture, such as a bunk bed) can be slid through prefabricated housing module 1500 and can be connected to a shell portion of prefabricated housing module 1500. For example, in some embodiments, bedroom cassette 1510 can include wheels or any other suitable mechanism for sliding the cassette through prefabricated housing module 1500. In another example, in some embodiments, prefabricated housing module 1500 can include a sliding mechanism for moving and installing cassettes within prefabricated housing module 1500. In another example, upon installing bedroom cassette 1510, electrical connections associated with bedroom cassette 1510 can be connected through the shell portion of prefabricated housing module 1500 and to the appropriate connectors in the MEP module or any other suitable portion of the central system module.

Figure 15B:
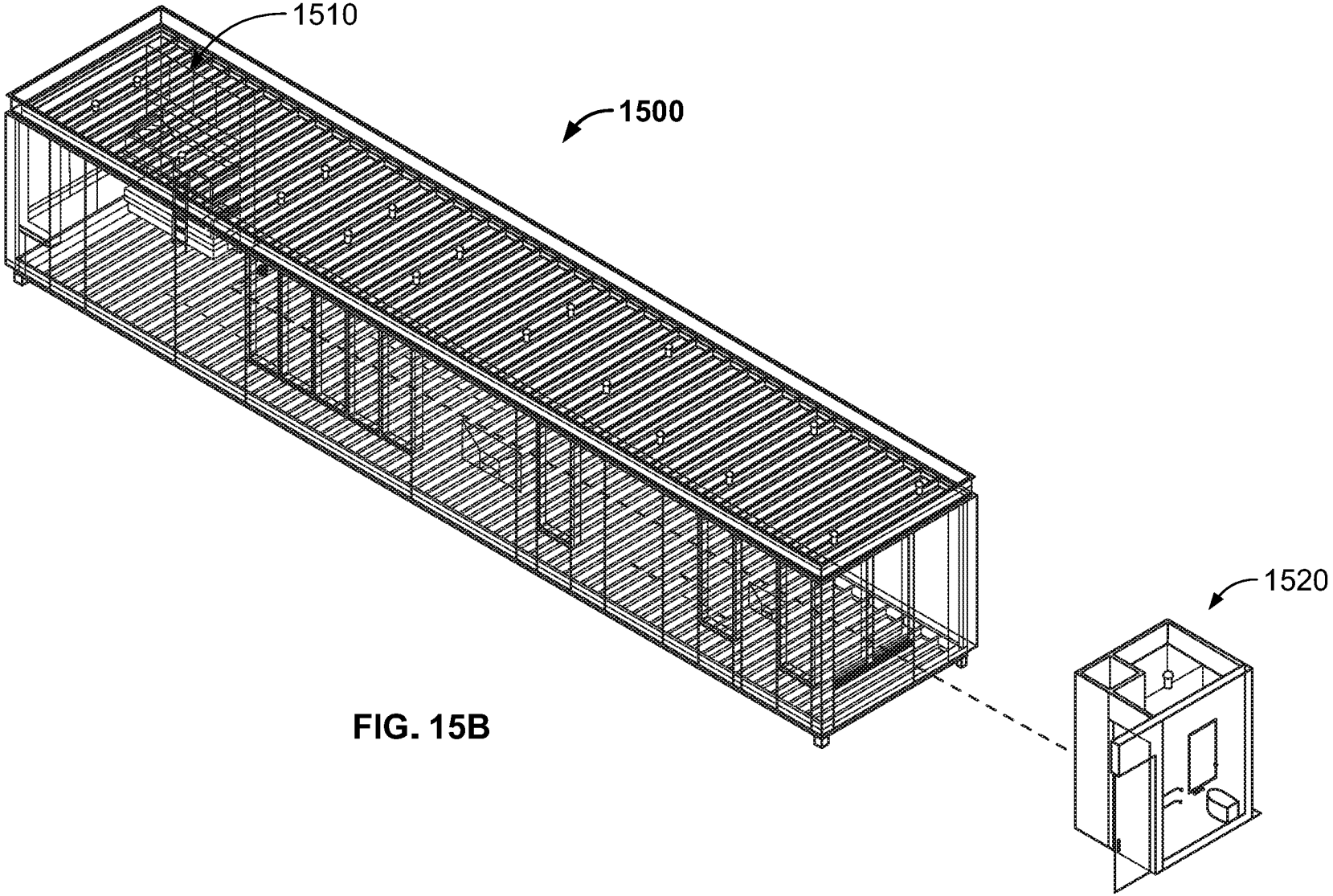
FIG. 15B shows an illustrative example of a bathroom cassette being slid through the housing module and being connected to a shell portion of the housing module that is adjacent to the bedroom cassette in accordance with some embodiments of the disclosed subject matter.

Turning to FIG. 15B, a bathroom cassette 1520 (e.g., including a toilet and a sink) can be slid through prefabricated housing module 1500 and can be connected to a shell portion of prefabricated housing module 1500 that is adjacent to bedroom cassette 1510. Upon installing bathroom cassette 1520, hot water pipes, cold water pipes, sewage and/or drainage pipes associated with bathroom cassette 1520 can be connected through the shell portion of prefabricated housing module 1500 and to the appropriate connectors in the MEP module or any other suitable portion of the central system module.

Figure 15C:
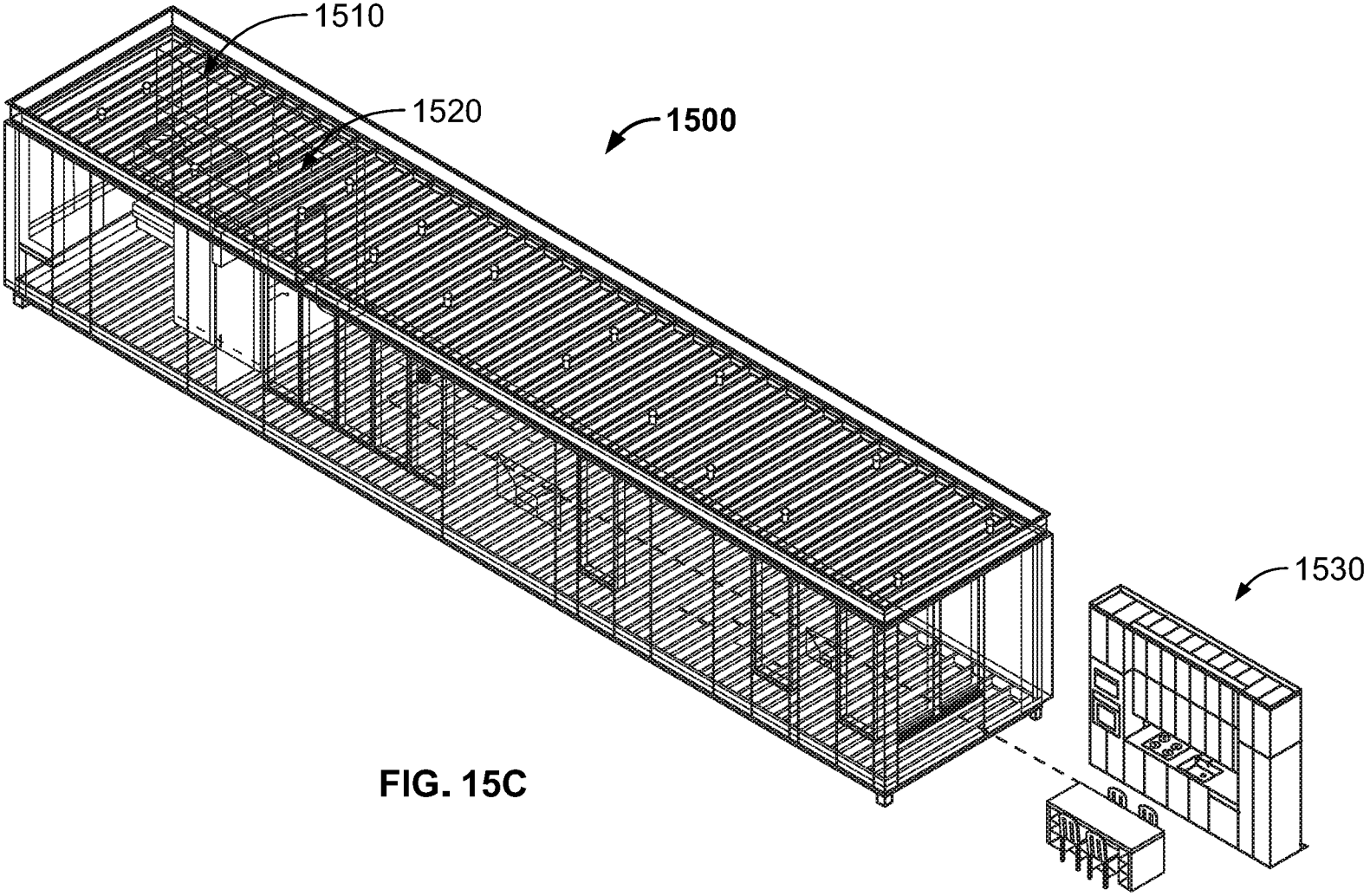
FIG. 15C shows an illustrative example of a kitchen cassette being slid through the housing module and being connected to a shell portion of the housing module that is adjacent to the bathroom cassette in accordance with some embodiments of the disclosed subject matter.

Turning to FIG. 15C, a kitchen cassette 1530 (e.g., including kitchen appliances, a sink, one or more cabinets, and a kitchen counter and/or table) can be slid through prefabricated housing module 1500 and can be connected to a shell portion of prefabricated housing module 1500 that is adjacent to bathroom cassette 1520. Upon installing kitchen cassette 1530, hot water pipes, cold water pipes, sewage and/or drainage pipes, electrical connections, and/or gas connections associated with kitchen cassette 1530 can be connected through the shell portion of prefabricated housing module 1500 and to the appropriate connectors in the MEP module or any other suitable portion of the central system module.

Figure 15D:
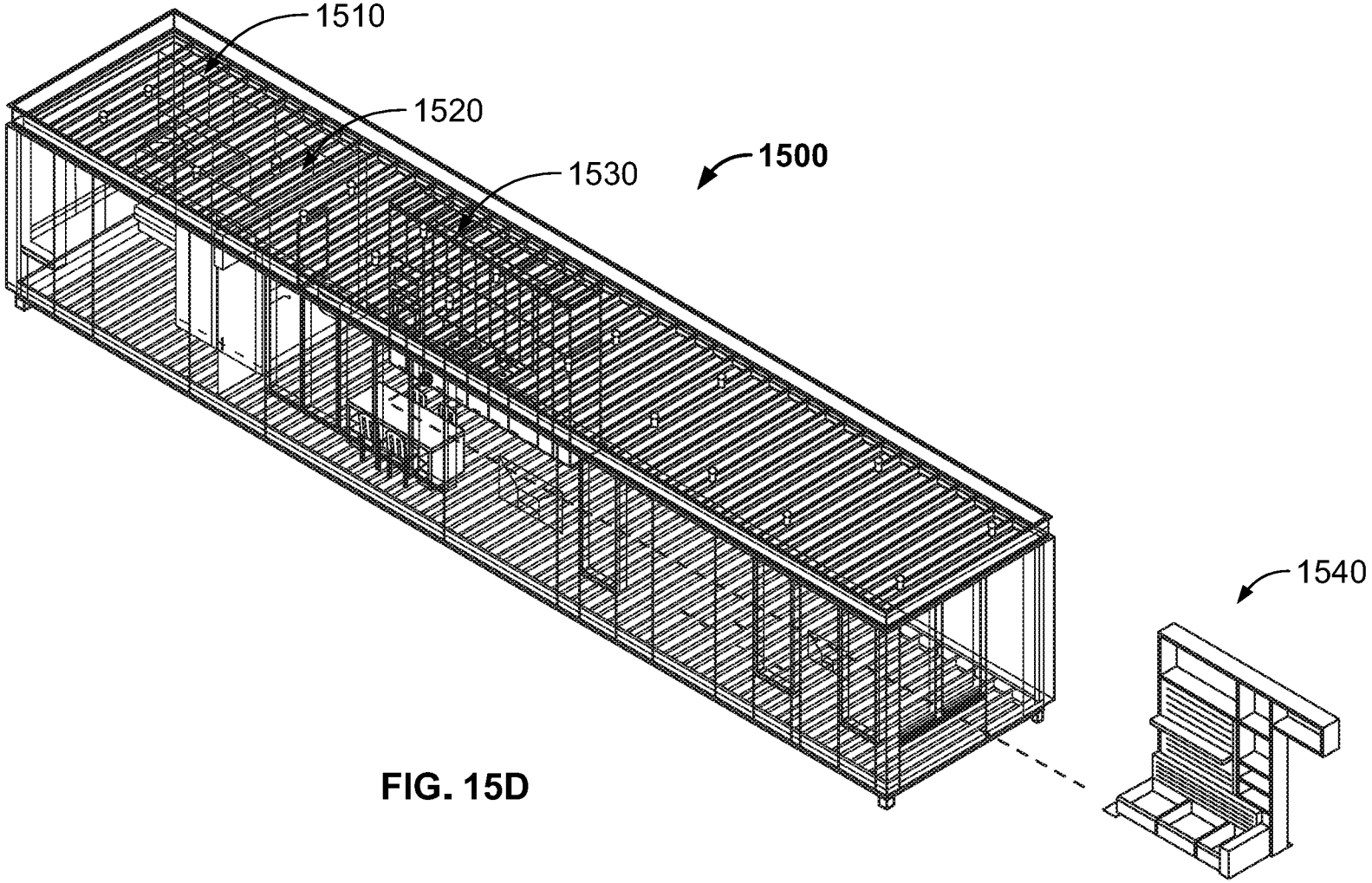
FIG. 15D shows an illustrative example of a dining area cassette being slid through the housing module and being connected to a shell portion of the housing module that is adjacent to the kitchen cassette in accordance with some embodiments of the disclosed subject matter.

Turning to FIG. 15D, a dining room cassette 1540 (e.g., including dining room furniture) can be slid through prefabricated housing module 1500 and can be connected to a shell portion of prefabricated housing module 1500 that is adjacent to kitchen cassette 1530. Upon installing kitchen cassette 1540, electrical connections associated with dining room cassette 1540 can be connected through the shell portion of prefabricated housing module 1500 and to the appropriate connectors in the MEP module or any other suitable portion of the central system module.

Figure 15E:
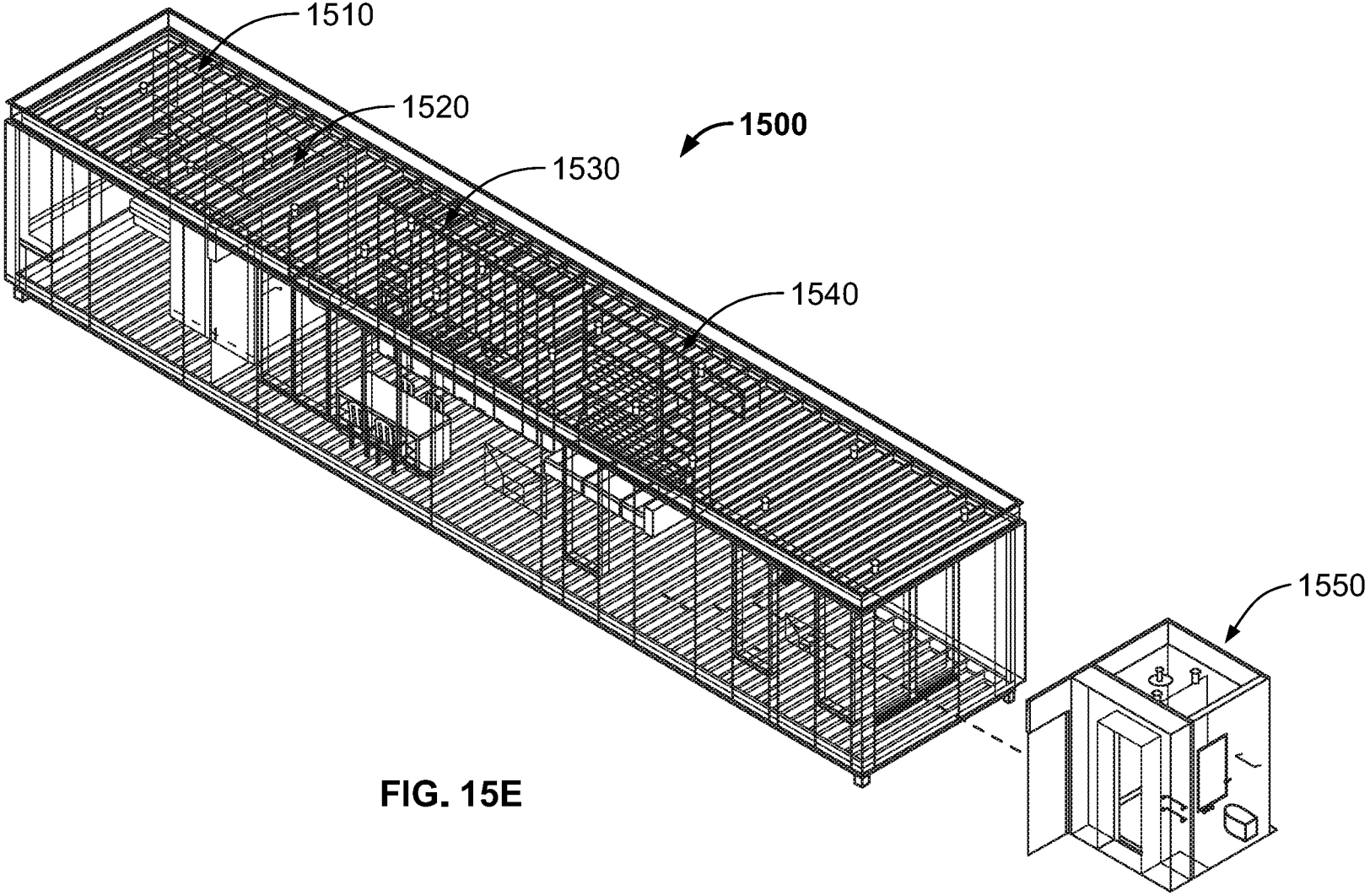
FIG. 15E shows an illustrative example of a master bathroom cassette being slid through the housing module and being connected to a shell portion of the housing module that is adjacent to the dining area cassette in accordance with some embodiments of the disclosed subject matter.

Turning to FIG. 15E, a master bathroom cassette 1550 (e.g., including a toilet, a bath/shower, and a sink) can be slid through prefabricated housing module 1500 and can be connected to a shell portion of prefabricated housing module 1500 that is adjacent to dining room cassette 1540. Upon installing master bathroom cassette 1550, hot water pipes, cold water pipes, sewage and/or drainage pipes associated with master bathroom cassette 1550 can be connected through the shell portion of prefabricated housing module 1500 and to the appropriate connectors in the MEP module or any other suitable portion of the central system module.

Figure 15F:
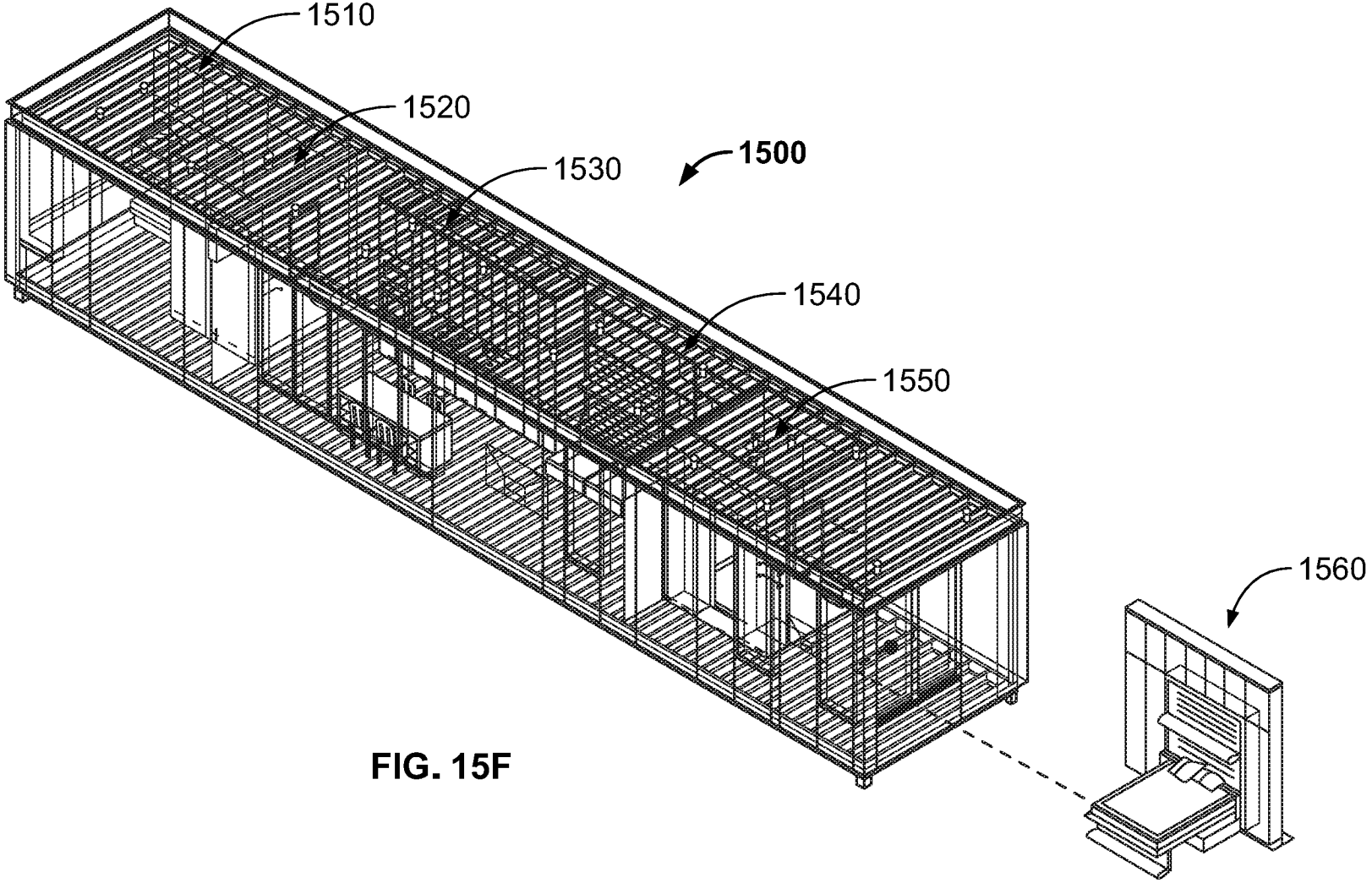
FIG. 15F shows an illustrative example of a master bedroom cassette being slid through the housing module and being connected to a shell portion of the housing module that is adjacent to the master bathroom cassette in accordance with some embodiments of the disclosed subject matter.

Turning to FIG. 15F, a master bedroom cassette 1560 (e.g., including a bed and other bedroom furniture) can be slid through prefabricated housing module 1500 and can be connected to a shell portion of prefabricated housing module 1500 that is adjacent to master bedroom cassette 1560. Upon installing master bedroom cassette 1560, electrical connections associated with master bedroom cassette 1560 can be connected through the shell portion of prefabricated housing module 1500 and to the appropriate connectors in the MEP module or any other suitable portion of the central system module.

Figure 15G:
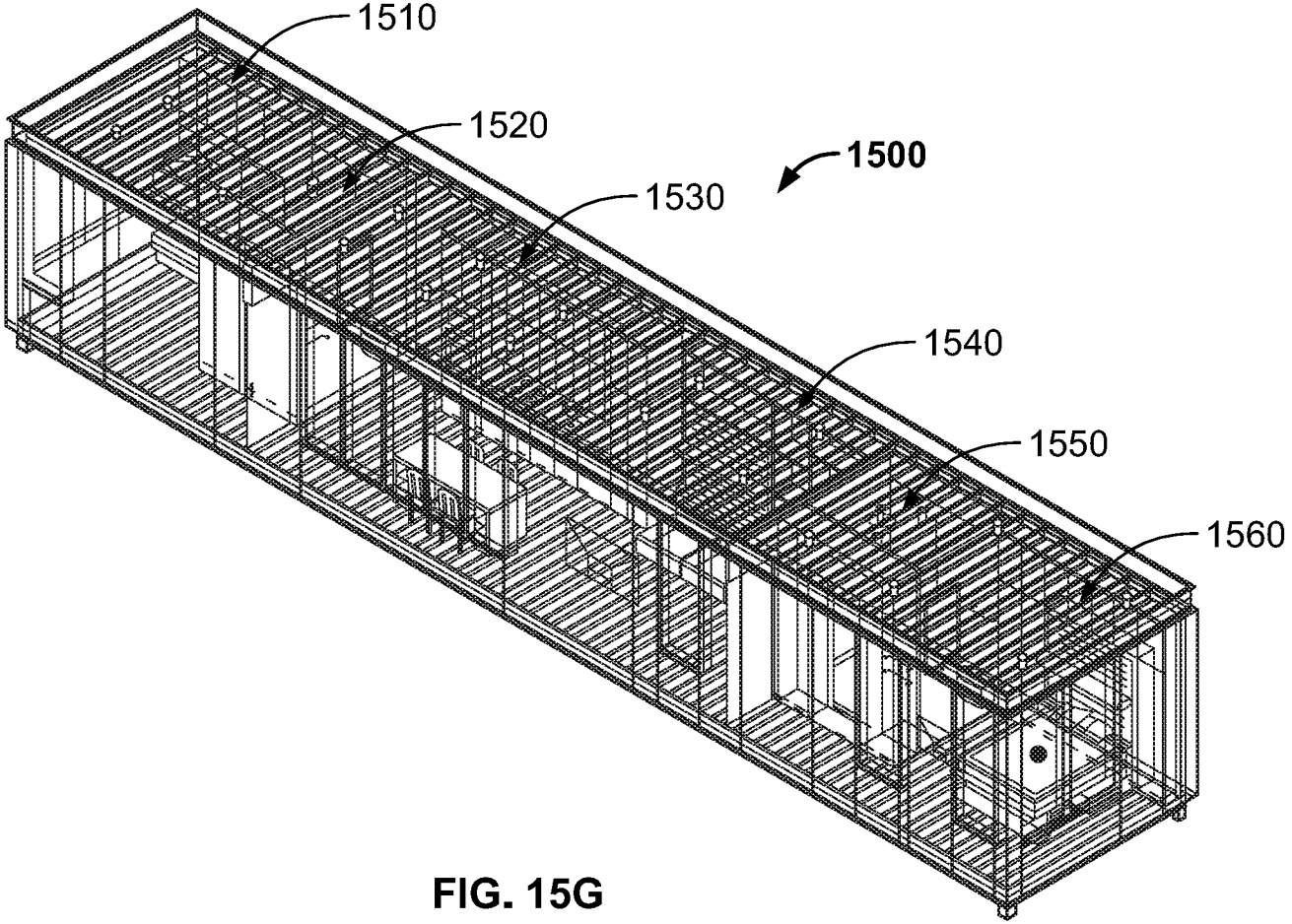
FIG. 15G shows an illustrative example of the housing module in which multiple cassettes have been installed to the shell of the housing module in accordance with some embodiments of the disclosed subject matter.

Accordingly, FIG. 15G shows prefabricated housing module 1500 in which multiple cassettes have been slid through prefabricated housing module 1500 and connected to an appropriate shell portion of prefabricated housing module 1500. It should be noted that, although FIGS. 15A through 15G generally show that the cassettes are installed adjacent and/or abutting each other along a wall or shell portion of prefabricated housing module 1500, this is merely illustrative. For example, cassettes can be configured in any suitable manner. In another example, substantial space can be left between cassettes (e.g., to create an open area without furniture or appliances).

It should be noted that, although the prefabricated housing modules described herein have substantially similar dimensions, this is merely illustrative. For example, the prefabricated housing modules can be arranged about the central systems module (e.g., which may include a MEP module, an elevator module, a stair module, and/or other suitable modules) in an angular or stair-like arrangement. As a more particular example, the prefabricated housing modules can be arranged about the central system module in a partially over-lapping fashion such that roof patios and other living structures are created.

In some embodiments, the modular housing system can include any suitable type of crane fittings. For example, the crane fittings can be a hook-like or loop-like fitting that are affixed to a top perimeter surface of each prefabricated system module such as to allow the prefabricated system module to be lifted by a crane. As another example, the crane fittings can be fittings configured for attachment to the base of a crane such as to allow the crane to be attached to a prefabricated system module or the central system module and to lift one or more prefabricated housing modules. As a more particular example, the crane fittings can be disposed onto the prefabricated system module in a manner configured to accommodate a crane designed specifically to move the modules described herein (e.g., a crane of a size and shape designed to fit on top of the modules and stably lift the modules for removal and/or placement). In some embodiments, the prefabricated housing modules can also include crane fittings.

In some embodiments, each of the modules in the modular housing system can include hydraulic jacks or any other suitable lifting mechanism. For example, in order to insert a third prefabricated housing module in a stacked housing unit between a first prefabricated housing module that is connected to a second prefabricated housing module (where the second prefabricated housing module is above the first prefabricated housing module), the fittings associated with the first prefabricated housing module and the second prefabricated housing module can be released and the hydraulic jacks integrated within the second prefabricated housing module can be activated to raise the second prefabricated housing module by a predetermined distance (e.g., at least the height of the third prefabricated housing module). In continuing this example, the third prefabricated housing module can be positioned between the first prefabricated housing module and the second prefabricated housing module (e.g., using a crane connected to the central system module). This can, for example, allow a module or a connected unit of modules to be removed and/or replaced. In a more particular example, a housing module that includes one bedroom can be upgraded with a replacement housing module that includes three bedrooms. In another more particular example, a housing module having a particular configuration, such as an open layout, can be replaced with a replacement housing module that includes a different configuration.

Accordingly, a modular housing system and methods for using the same are provided.

Although the invention has been described and illustrated in the foregoing illustrative embodiments, it is understood that the present disclosure has been made only by way of example, and that numerous changes in the details of implementation of the invention can be made without departing from the spirit and scope of the invention. Features of the disclosed embodiments can be combined and rearranged in various ways.

What is claimed is:

1. A modular housing system, comprising:

a single mechanical, electrical, and plumbing (MEP) module that includes a first plurality of utilities connectors that connect each of a plurality of utilities between a utilities source, a first plurality of prefabricated housing modules, and a second plurality of prefabricated housing modules, wherein the single MEP module has a first side that is connected to the first plurality of prefabricated housing modules, a second side that is an opposing side to the first side and is connected to the second plurality of prefabricated housing modules, and a third side that is orthogonal to the first side and the second side and is connected to an additional MEP module, wherein the additional MEP module includes a second plurality of utilities connectors that connect each of the plurality of utilities between the utilities source and at least one of the first plurality of prefabricated housing modules, the second plurality of prefabricated housing modules, and additional prefabricated housing modules;

the first plurality of prefabricated housing modules that are connected along the first side of the single MEP module, wherein each of the first plurality of prefabricated housing modules is vertically aligned with each other to form a first stacked housing unit that is connected and joined to the single MEP module with a fastener assembly; and the second plurality of prefabricated housing modules that are connected along the second side of the single MEP module, wherein each of the second plurality of prefabricated housing modules is vertically aligned with each other to form a second stacked housing unit and joined to the single MEP module with the fastener assembly and wherein the first stacked housing unit and the second stacked housing unit are formed on opposing ends of the single MEP module.

2. The modular housing system of claim 1, wherein, upon connecting the first plurality of prefabricated housing modules and the second plurality of prefabricated housing modules in the modular housing system using preconfigured fittings, a portion of the first plurality of prefabricated housing modules and a portion of the second plurality of prefabricated housing modules form opposing ends of an elevator module.

3. The modular housing system of claim 2, wherein the elevator module is configured to be disconnected from the first plurality of prefabricated housing modules and the second plurality of prefabricated housing modules and replaced with a replacement elevator module.

4. The modular housing system of claim 2, wherein the single MEP module is connected to a perimeter portion of the elevator module.

5. The modular housing system of claim 1, wherein, upon connecting the first plurality of prefabricated housing modules and the second plurality of prefabricated housing modules in the modular housing system using preconfigured fittings, a portion of the first plurality of prefabricated housing modules and a portion of the second plurality of prefabricated housing modules form opposing ends of an egress stair module.

6. The modular housing system of claim 5, wherein the single MEP module is connected to a rear perimeter portion of the egress stair module.

7. The modular housing system of claim 1, wherein a number of the first plurality of prefabricated housing modules is the same as a number of the second plurality of prefabricated housing modules.

8. The modular housing system of claim 1, wherein a number of the first plurality of prefabricated housing modules is different than a number of the second plurality of prefabricated housing modules.

9. The modular housing system of claim 1, wherein at least a portion of the first plurality of prefabricated housing modules is configured to be removed from the modular housing system and replaced with a replacement prefabricated housing module.

10. The modular housing system of claim 1, wherein at least a portion of the second plurality of prefabricated housing modules is configured to be removed from the modular housing system and replaced with a replacement prefabricated housing module.

11. The modular housing system of claim 1, wherein each of the first plurality of prefabricated housing modules and each of the second plurality of prefabricated housing modules comprises a shell portion and wherein at least one of the first plurality of prefabricated housing modules and the second plurality of prefabricated housing modules comprises a plurality of cassettes that are each installed within a prefabricated housing module in one of the first plurality of prefabricated housing modules and the second plurality of prefabricated housing modules along the shell portion of the prefabricated housing module.

12. The modular housing system of claim 11, wherein each of the plurality of cassettes corresponds with an area within the prefabricated housing module, wherein the area is one of: a bedroom area, a bathroom, a kitchen area, a living room area, and a dining area.

13. The modular housing system of claim 11, wherein each of the plurality of cassettes is attached to a portion of the prefabricated housing module that includes connectors that connect each of the attached plurality of cassettes to the single MEP module.

14. The modular housing system of claim 13, wherein the connectors are formed through the shell portion of the prefabricated housing module that each connect one of a plurality of utilities between the utilities source and a component in the cassette.

15. The modular housing system of claim 11, wherein each of the plurality of cassettes is capable of being slid to move a cassette along a perimeter of the prefabricated housing module for installation.

16. The modular housing system of claim 11, wherein each of the plurality of cassettes is configured to be installed along a shell portion of the prefabricated housing module such that a first cassette is adjacent to a second cassette.

17. The modular housing system of claim 1, wherein the single MEP module is configured to be disconnected and replaced with a replacement MEP module.

18. The modular housing system of claim 1, wherein each of the first plurality of prefabricated housing modules and the second plurality of prefabricated housing modules is configured to be removed from the modular housing system and replaced with a replacement prefabricated system module.

19. The modular housing system of claim 1, wherein each of the first plurality of prefabricated housing modules and each of the second plurality of prefabricated housing modules comprises one or more crane fittings that are configured to allow a crane to attach to a particular prefabricated housing module.

20. The modular housing system of claim 1, further comprising a plurality of prefabricated system modules that are vertically aligned with each other and joined with the fastener assembly to form a central system module, wherein the plurality of prefabricated system modules are connected to the first plurality of prefabricated housing modules and the second plurality of prefabricated housing modules.

* * * * *